US011970247B2

(12) United States Patent
Dent

(10) Patent No.: US 11,970,247 B2
(45) Date of Patent: Apr. 30, 2024

(54) TRANSPORTABLE WATERBOARDS, AND ASSOCIATED SYSTEMS AND METHODS

(71) Applicant: Jefferson Dent, Tauranga (NZ)

(72) Inventor: Jefferson Dent, Tauranga (NZ)

( * ) Notice: Subject to any disclaimer, the term of this patent is extended or adjusted under 35 U.S.C. 154(b) by 0 days.

(21) Appl. No.: 18/170,470

(22) Filed: Feb. 16, 2023

(65) Prior Publication Data

US 2023/0264791 A1 Aug. 24, 2023

(30) Foreign Application Priority Data

Feb. 18, 2022 (NZ) ..... 783501

(51) Int. Cl.
*B63B 32/53* (2020.01)
*B63B 32/40* (2020.01)

(52) U.S. Cl.
CPC ..... *B63B 32/53* (2020.02); *B63B 32/40* (2020.02)

(58) Field of Classification Search
CPC ..... B63B 32/40; B63B 32/53
See application file for complete search history.

(56) References Cited

U.S. PATENT DOCUMENTS 3,287,754 A 11/1966 Price et al.
5,711,692 A * 1/1998 Pope ..... B63B 32/53 441/74
6,656,005 B2 12/2003 Meyerhoffer
7,121,909 B1 10/2006 Meyerhoffer
7,347,755 B1 * 3/2008 Katzfey ..... B63B 32/53 441/74
7,390,234 B2 * 6/2008 Peach ..... B63B 32/87 441/74
8,123,580 B1 * 2/2012 Meyerhoffer ..... B63B 32/53 441/74
8,469,756 B2 * 6/2013 Becker ..... B63B 32/53 441/74
2006/0189228 A1 * 8/2006 Murphy ..... B63B 32/53 441/74

(Continued)

FOREIGN PATENT DOCUMENTS

AU 2011220849 B2 1/2015
DE 3043851 A1 * 4/1982 ..... B63B 32/53
DE 20022006 U1 3/2001

(Continued)

OTHER PUBLICATIONS

ISA/US , "International Search Report and Written Opinion", for Application No. PCT/IB2023/051429, dated Jun. 7, 2023, 10 pages.

*Primary Examiner* — Ajay Vasudeva
(74) *Attorney, Agent, or Firm* — Perkins Coie LLP

(57) ABSTRACT

A waterboard assembly (such as a surfboard assembly) may include a first body portion, a second body portion, and a joining mechanism positioned to releasably attach the first body portion to the second body portion. In some embodiments, the joining mechanism may include a first interlocking portion and a second interlocking portion. The first interlocking portion may be attached to, integral with, or part of, the first body portion. The second interlocking portion may be attached to, integral with, or part of, the second body portion. The first interlocking portion may releasably interlock with the second interlocking portion. In some embodiments, the joining mechanism may include one or more fasteners for holding the interlocking portions together.

11 Claims, 19 Drawing Sheets

(56) References Cited

U.S. PATENT DOCUMENTS

| | | | | |
|---|---|---|---|---|
| 2013/0029547 | A1* | 1/2013 | Suzuki | B63B 32/53<br>441/74 |
| 2017/0144735 | A1 | 5/2017 | Sciarra | |

FOREIGN PATENT DOCUMENTS

| | | | | |
|---|---|---|---|---|
| FR | 2532269 | A1 * | 3/1984 | B63B 32/53 |
| FR | 2978114 | A1 * | 1/2013 | B63B 32/53 |
| GB | 2469504 | A | 10/2010 | |
| KR | 200471485 | Y1 | 3/2014 | |
| WO | WO-9211181 | A1 * | 7/1992 | B63B 35/7916 |
| WO | 2007106932 | A1 | 9/2007 | |

* cited by examiner

TRANSPORTABLE WATERBOARDS, AND ASSOCIATED SYSTEMS AND METHODS

CROSS-REFERENCE TO RELATED APPLICATION

The present application claims priority to New Zealand Patent Application No. 783501, filed Feb. 18, 2022, and titled "Improvements to Recreational Apparatus and Methods of Manufacture," which is incorporated herein by reference in its entirety.

BACKGROUND

Conventional floatable water-recreational devices or waterboards, such as surfboards, bodyboards (sometimes called "Boogie Boards"), and paddleboards, are often large and bulky. For example, conventional surfboards may be several feet long, or in the case of "longboards," as much as 11 feet long, or more. As a result, conventional waterboards may be difficult to transport in vehicles and may occupy a large amount of space in storage. Some such devices may be transported in specially designed carrier apparatuses that are mountable to a vehicle, such as a roof rack or a long case or bag. But these carrier apparatuses may be costly or inconvenient. And in some cases, conventional waterboards may be so large that they cannot be transported in some modes of transportation at all. The inability to easily transport large recreational devices limits their utility and enjoyment. Aspects of embodiments of the present technology address these issues and other issues.

SUMMARY

Representative embodiments of the present technology include a waterboard assembly (such as a surfboard assembly) having a first body portion, a second body portion, and a joining mechanism positioned to releasably attach the first body portion to the second body portion. In some embodiments, the joining mechanism may include a first interlocking portion and a second interlocking portion. The first interlocking portion may be attached to, integral with, or part of, the first body portion. The second interlocking portion may be attached to, integral with, or part of, the second body portion. The first interlocking portion may releasably interlock with the second interlocking portion. In some embodiments, the joining mechanism may include one or more fasteners for holding the interlocking portions together.

Other features, embodiments, and advantages will appear hereinafter. The features described herein can be used separately or together, or in various combinations of one or more of them.

BRIEF DESCRIPTION OF THE DRAWINGS

In the drawings, wherein the same reference number indicates the same element throughout the several views:

(FIG. 5 illustrates a top perspective exploded/separated view of the interlocking portions, FIG. 6 illustrates a bottom perspective view of the structure shown in FIG. 5, FIG. 7 illustrates a top perspective view from the tail toward the nose, and FIG. 8 illustrates a bottom perspective view from the tail toward the nose);

DETAILED DESCRIPTION

The present technology is directed to transportable waterboards, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail to avoid unnecessarily obscuring the relevant description of the various embodiments. Accordingly, embodiments of the present technology may include additional elements or exclude some of the elements described below with reference to FIGS. 1-19, which illustrate examples of the technology.

The terminology used in this description is intended to be interpreted in its broadest reasonable manner, even though it is being used in conjunction with a detailed description of certain specific embodiments of the technology. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all the items in the list, or (c) any combination of items in the list. Further, unless otherwise specified, terms such as "attached" or "connected" are intended to include integral connections, as well as connections between physically separate components.

Figure 1:
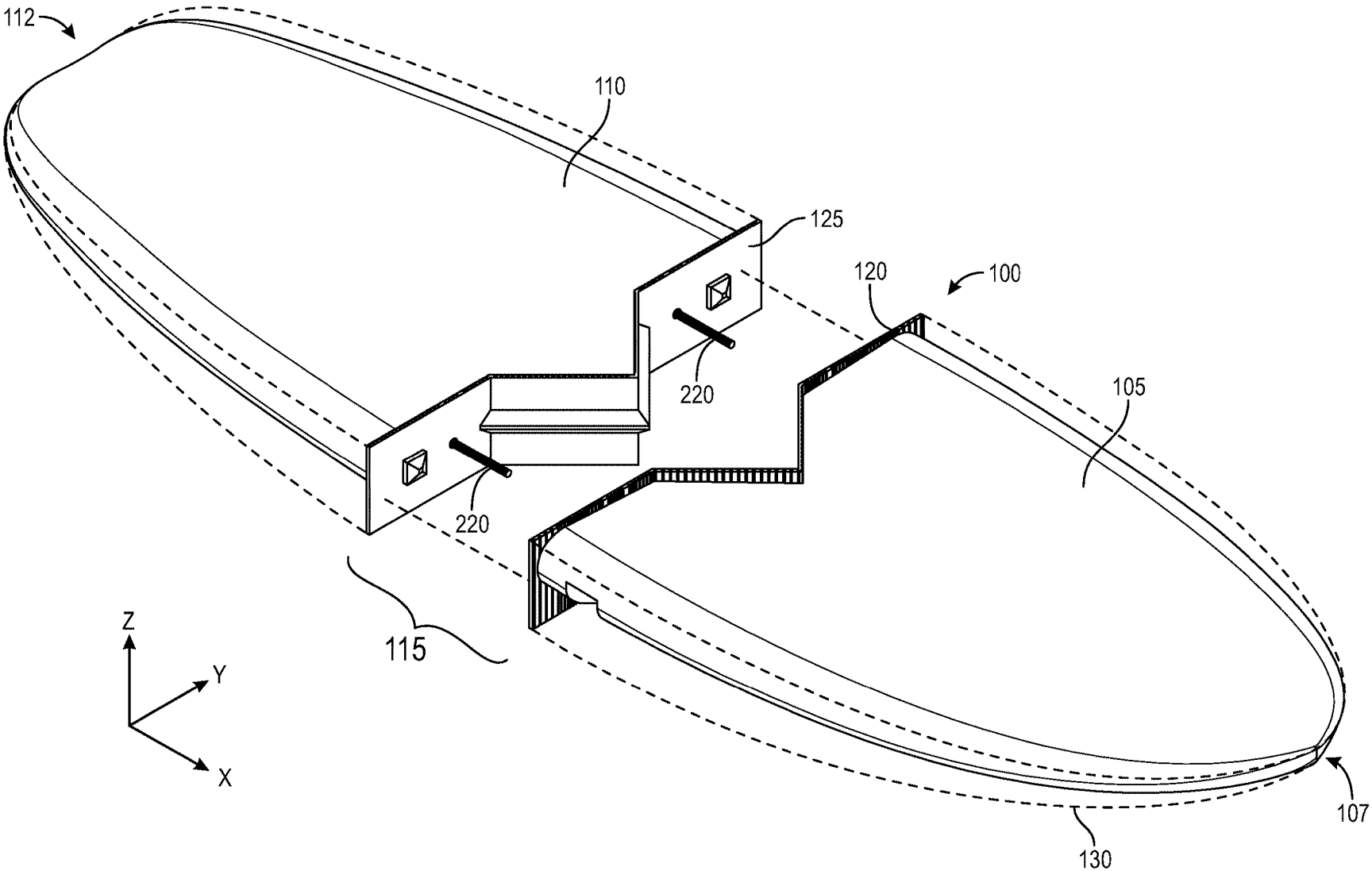
FIG. 1 illustrates a top perspective exploded view of a surfboard assembly configured in accordance with embodiments of the present technology.

FIG. 1 illustrates a top perspective exploded or partially disassembled view of a waterboard or surfboard assembly 100 (hereinafter referred to as a surfboard 100 for brevity) configured in accordance with embodiments of the present technology. FIG. 1 shows the top surface of the surfboard 100 upon which a user stands, lies, or otherwise is supported. In some embodiments, the surfboard 100 includes a first body portion 105, a second body portion 110, and a joining mechanism 115 positioned and configured to releasably attach the first body portion 105 to the second body portion 110. In some embodiments, the joining mechanism 115 can be positioned generally towards a middle area of the surfboard 100, which facilitates separation of the surfboard 100 into smaller components (the body portions 105, 110) for more compact storage and transportation.

Although two body portions 105, 110 are shown and described herein, in further embodiments, the surfboard 100 may be divided into more than two body portions, such as three or more body portions, with each adjacent body portion being releasably attachable by a joining mechanism such as the joining mechanism 115. In some embodiments, the first body portion 105 may include a nose 107 of the surfboard 100 and the second body portion 110 may include a tail 112 of the surfboard 100, although in further embodiments, the orientation and position of the body portions 105, 110 or the joining mechanism 115 may be different.

In some embodiments, the joining mechanism 115 includes a first interlocking portion 120 and a second interlocking portion 125. The interlocking portions 120, 125 may be correspondingly shaped and configured to releasably interlock with each other. In some embodiments, the first interlocking portion 120 is attached to or integral with the first body portion 105, and the second interlocking portion 125 is attached to or integral with the second body portion 110.

In some embodiments, one or both of the body portions 105, 110 may be formed from a foam material. In some embodiments, the surfboard 110 may further include one or more layers of covering material 130, which may include at least one of an epoxy material, a fiberglass material, a composite material, a plastic material, or another material suitable for covering the body portions 105, 110. In FIG. 1, the covering material 130 is shown with dashed lines. In some embodiments, the covering material 130 may be shaped or configured to form a generally smooth or uniform surface along the surfboard 100 when the first body portion 105 is attached to the second body portion 110.

For explanation and illustration purposes only, x (longitudinal), y (lateral), and z (thickness) axes are shown in FIG. 1. In some embodiments, the interlocking portions 120, 125 may be larger in they (lateral) and z (thickness) axes than the body portions 105, 110, and the covering material 130 may account for that size difference to accommodate a smooth transition from the interlocking portions 120, 125 to the remainder of the length and width of the surfboard 100.

As described in further detail below regarding FIGS. 5-8, in some embodiments, the surfboard 100 may include one or more fasteners 500 that are positioned or positionable for attaching the first interlocking portion 120 to the second interlocking portion 125 and therefore forming a built and ready-to-ride surfboard 100.

Figure 2:
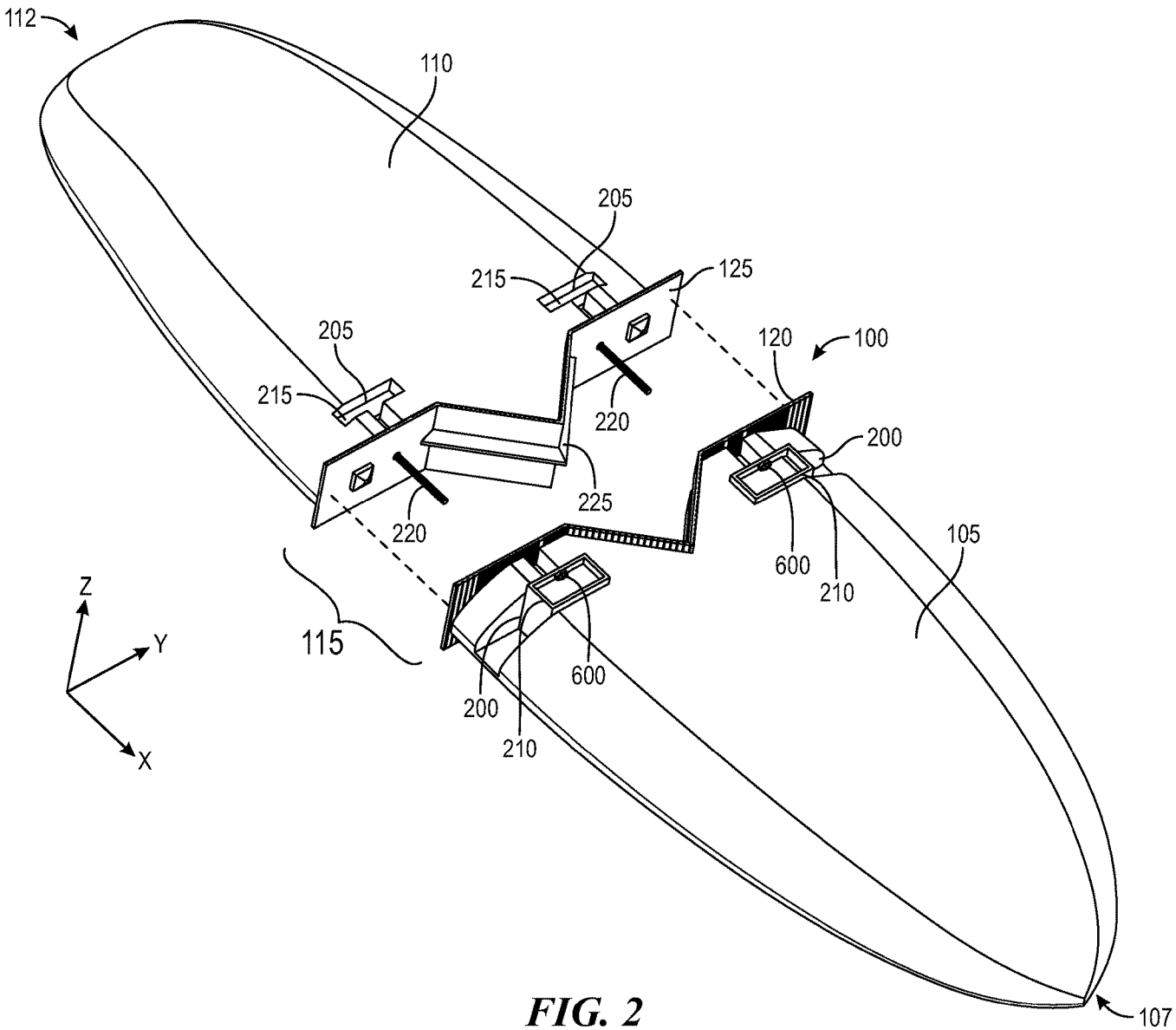
FIG. 2 illustrates a bottom perspective exploded or partially disassembled view of a portion of the surfboard shown in FIG. 1.

FIG. 2 illustrates a bottom perspective exploded or partially disassembled view of a portion of the surfboard 100 shown in FIG. 1. In FIG. 2, the covering material 130 is not shown to avoid obscuring other aspects of FIG. 2. In some embodiments, the first body portion 105 includes one or more first recesses 200 (such as two first recesses 200) shaped and positioned to receive or contain at least part of the first interlocking portion 120. For example, the one or more first recesses 200 may be shaped and positioned to receive or contain one or more first fastener receptacles 210 (such as two first fastener receptacles 210, each first fastener receptacle 210 being positioned or positionable in a corresponding first recess 200).

In some embodiments, the second body portion 110 includes one or more second recesses 205 (such as two second recesses 205) shaped and positioned to receive or contain at least part of the second interlocking portion 125. For example, the one or more second recesses 205 may be shaped and positioned to receive or contain one or more second fastener receptacles 215 (such as two second fastener receptacles 215, each second fastener receptacle 215 being positioned or positionable in a corresponding second recess 205). The fastener receptacles 210, 215 are configured to receive one or more corresponding fasteners 220 of the joining mechanism 115, which are positioned and configured to releasably connect the first interlocking portion 120 to the second interlocking portion 125, as described in additional detail below and illustrated in FIGS. 5-8.

In some embodiments, the interlocking portions 120, 125 may be characterized as interlocking bracket elements attached to or otherwise at least partially carried in the body portions 105, 110. The first interlocking portion 120 and the second interlocking portion 125 may include interlocking features that resist relative movement between the first interlocking portion 120 and the second interlocking portion 125. For example, the second interlocking portion 125 may include a protrusion 225 shaped and positioned to be received in a cavity in the first interlocking portion 120.

Figure 3:
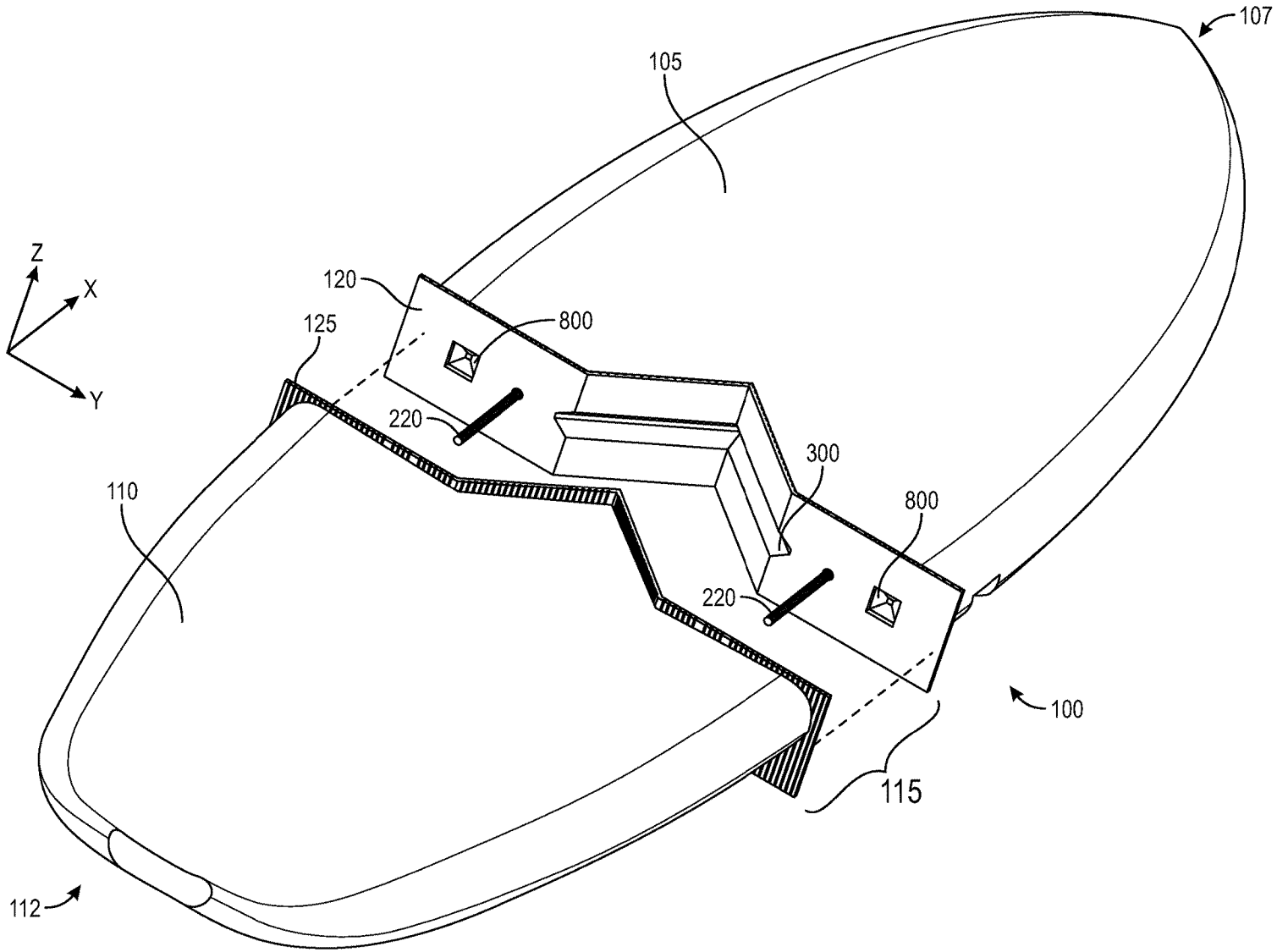
FIG. 3 illustrates a top perspective exploded or partially disassembled view of a portion of the surfboard shown in FIG. 1, looking along the surfboard from the tail toward the nose.
Figure 4:
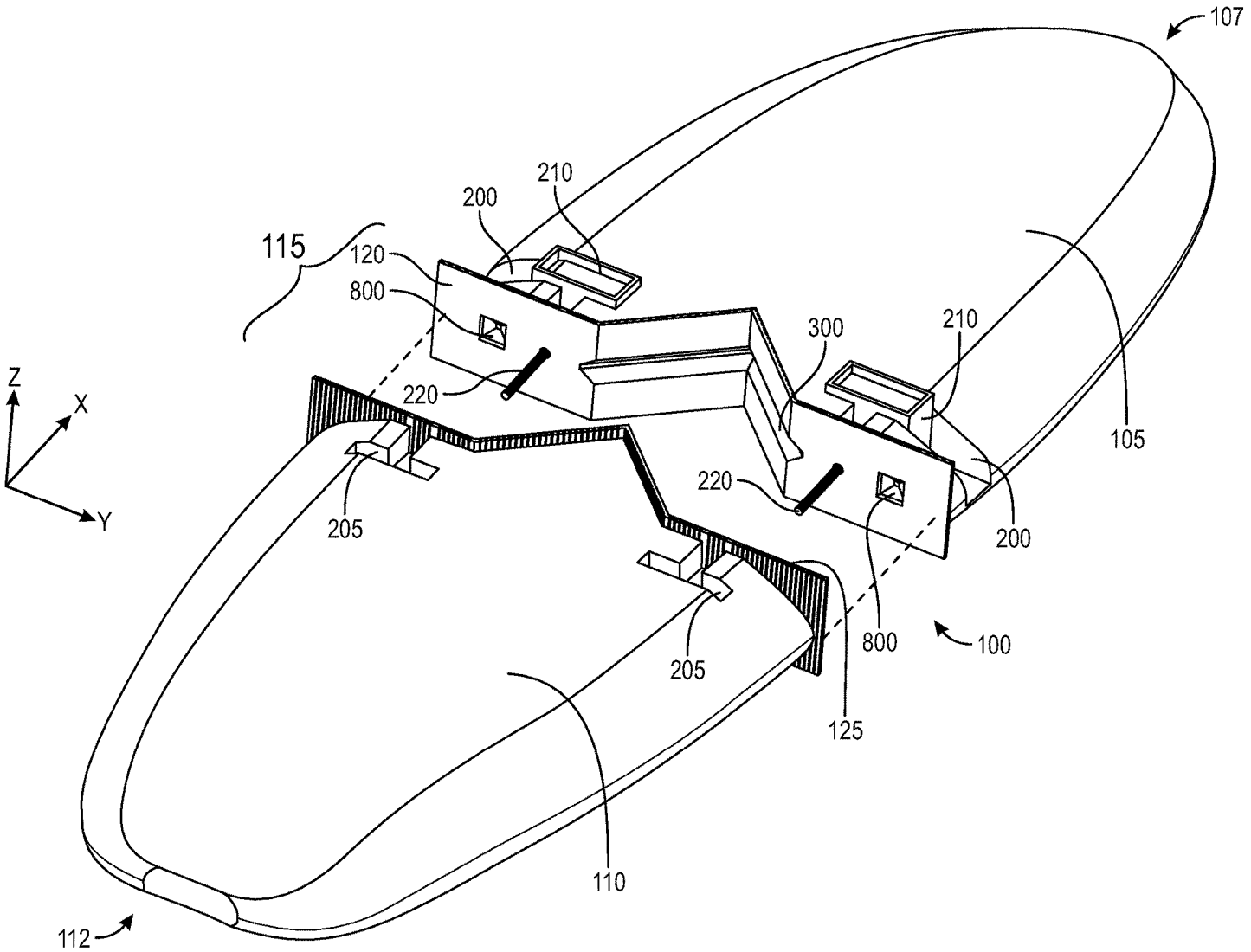
FIG. 4 illustrates a bottom perspective exploded or partially disassembled view of a portion of the surfboard shown in FIG. 1, looking along the surfboard from the tail toward the nose.

FIG. 3 illustrates a top perspective exploded or partially disassembled view of a portion of the surfboard 100 shown in FIG. 1, looking along the surfboard 100 from the tail 112 toward the nose 107. FIG. 4 illustrates a bottom perspective exploded or partially disassembled view of a portion of the surfboard 100 shown in FIG. 1, looking along the surfboard 100 from the tail 112 toward the nose 107. In FIGS. 3 and 4, the covering material 130 (see FIG. 1) is not shown to avoid obscuring other aspects of FIGS. 3 and 4.

With reference to both FIGS. 3 and 4, the first interlocking portion 120 may include the cavity 300 shaped and positioned to receive the protrusion 225 (see FIG. 2). In some embodiments, the first interlocking portion 120 may include the protrusion 225 and the second interlocking portion 125 may include the cavity 300. In some embodiments, each of the first interlocking portion 120 and the second interlocking portion 125 can include a protrusion 225, and each of the first interlocking portion 120 and the second interlocking portion 125 may include a corresponding cavity 300 shaped and positioned to receive the corresponding protrusion 225. In general, the interlocking portions 120, 125 may include any suitable quantity, configuration, or position of interlocking features such as the protrusion 225 and the cavity 300.

Figure 5:
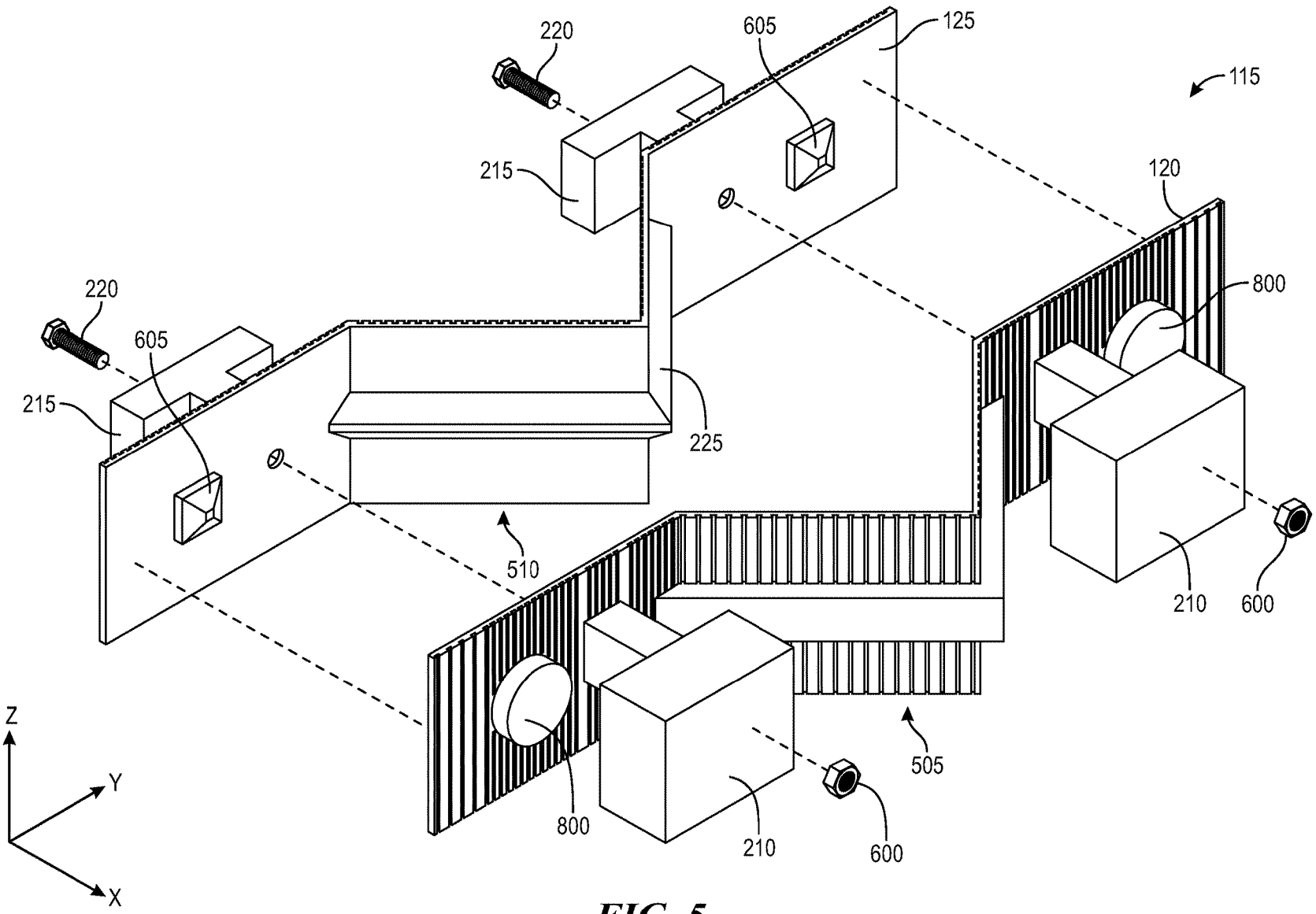
FIGS. 5-8 illustrate views of portions of a joining mechanism for a surfboard or waterboard, specifically, interlocking portions and fasteners for joining the interlocking portions together
Figure 6:
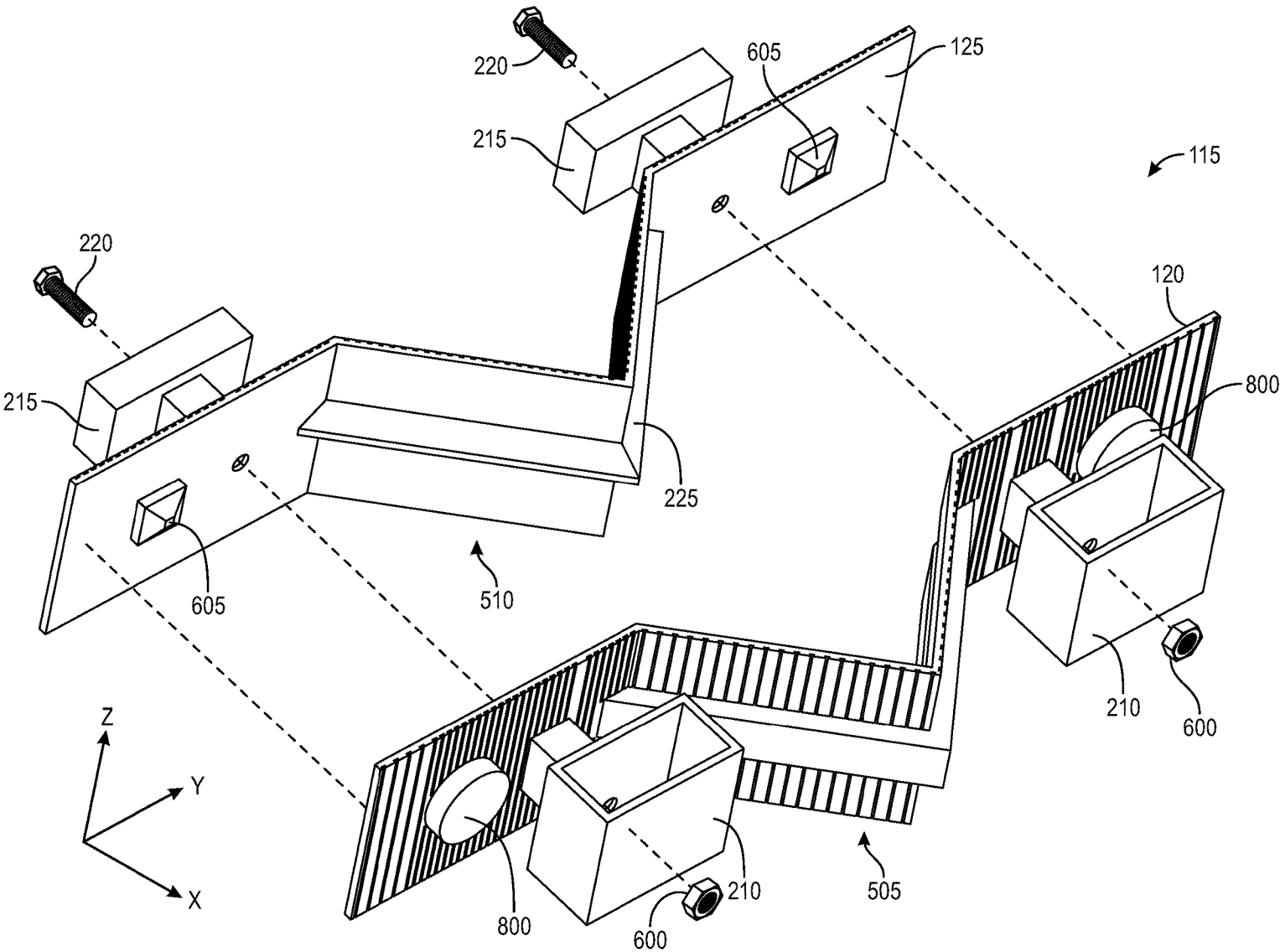
Figure 7:
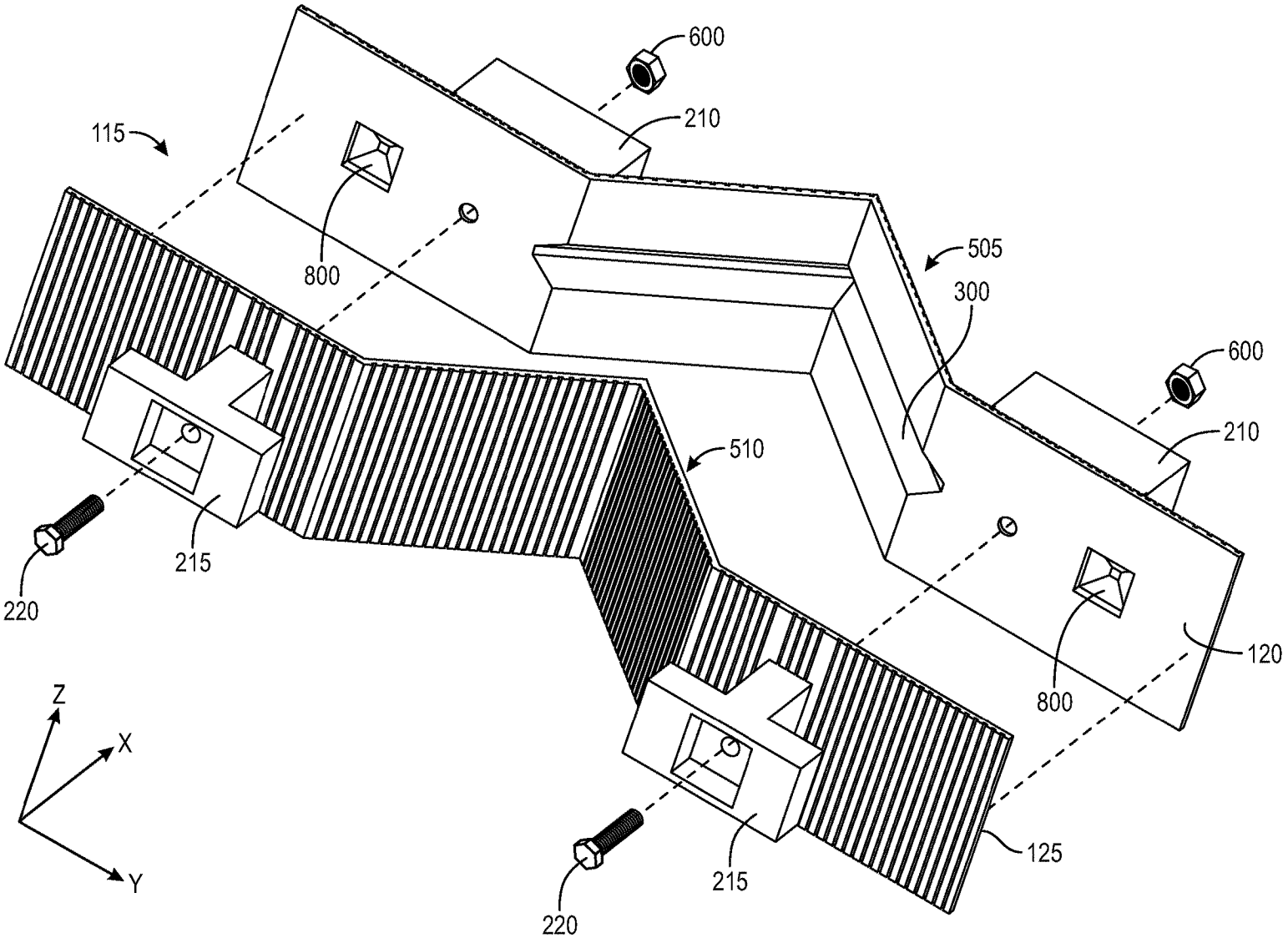
Figure 8:
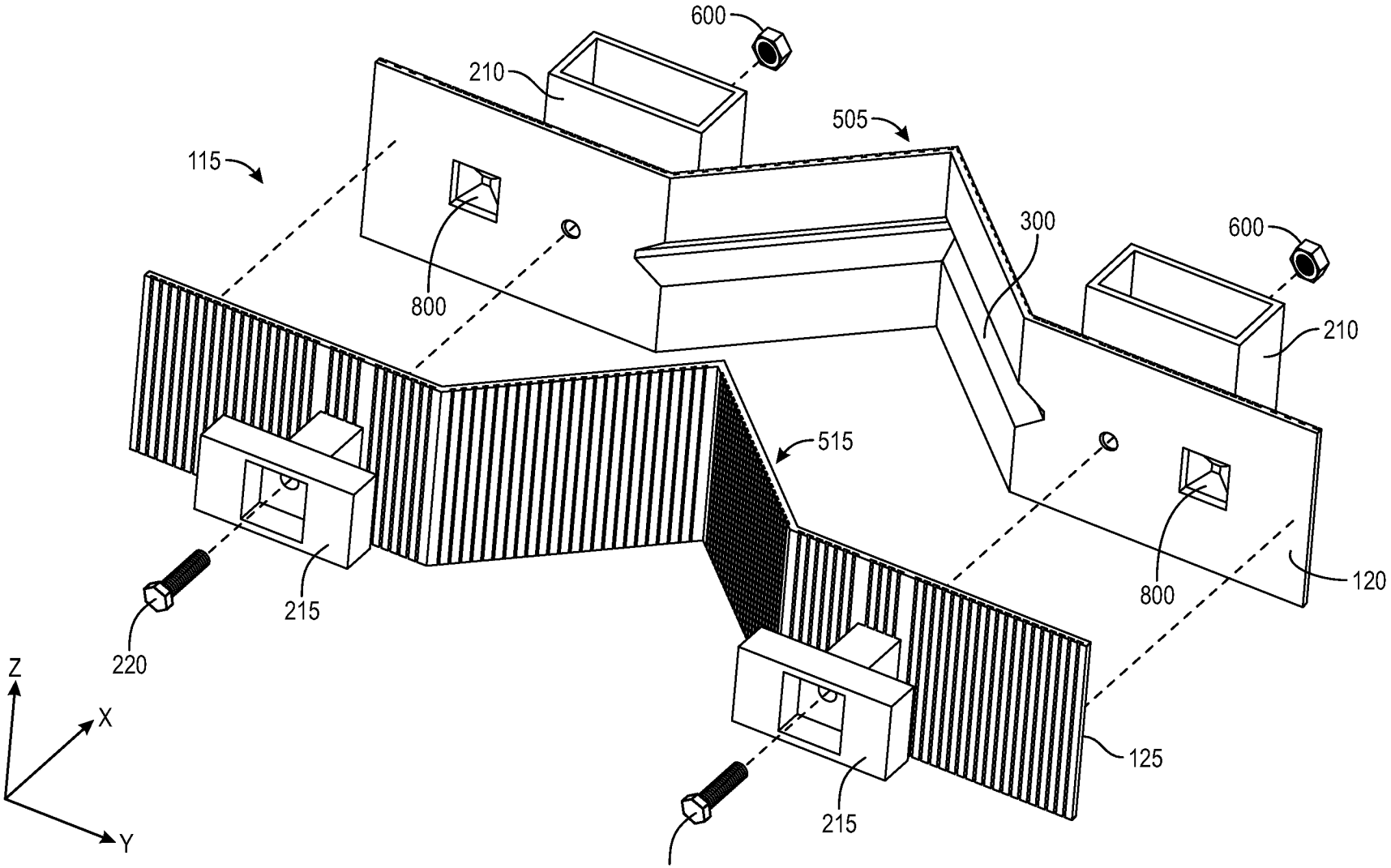

FIGS. 5-8 illustrate views of portions of the joining mechanism 115, specifically, the interlocking portions 120, 125 and fasteners for joining the interlocking portions 120, 125 together. FIG. 5 illustrates a top perspective exploded/separated view of the interlocking portions 120, 125 (a similar perspective as FIG. 1); FIG. 6 illustrates a bottom perspective view of the structure shown in FIG. 5 (a similar perspective as FIG. 2); FIG. 7 illustrates a top perspective view from the tail 112 toward the nose 107 (a similar perspective as FIG. 3); and FIG. 8 illustrates a bottom perspective view from the tail 112 toward the nose 107 (a similar perspective as FIG. 4).

With reference to FIGS. 5-8, in some embodiments, the first interlocking portion 120 and the second interlocking portion 125 may include complementary interlocking angular shapes that, when connected or interlocked together, resist relative movement between each other in at least two dimensions. For example, FIG. 5 shows x-, y-, and z-axes, where the x-axis extends along a longitudinal axis of the surfboard (between the tail 112 and the nose 107), the y-axis extends along a lateral axis of the surfboard (from one side to the other), and the z-axis extends orthogonally relative to the x- and y- axes through a thickness of the surfboard (FIG. 1 also shows these axes).

The interlocking portions 120, 125 can resist relative movement between each other in the y- and z-axes due to their complementary interlocking angular shapes. For example, in some embodiments, the first interlocking portion 120 comprises or may be characterized as a bracket element that extends along the lateral axis of the surfboard assembly (the y-axis) and includes a first bent portion 505 extending along the longitudinal axis of the surfboard assembly (the x-axis); and the second interlocking portion 125 comprises or may be characterized as a bracket element that extends along the lateral axis of the surfboard assembly (the y-axis) and includes a second bent portion 510 extending along the longitudinal axis of the surfboard assembly (the x-axis).

The bent portions 505, 510 may be or may include chevron shapes that nest or otherwise engage with each other and that point along the x-axis. The bent portions 505, 510 may resist relative movement between the interlocking portions 120, 125 along the lateral axis (the y-axis). The protrusion 225 and the cavity 300, which may extend along both the longitudinal axis (the x-axis) and the z-axis (thickness), may resist relative movement between the interlocking portions 120, 125 along at least the z-axis. In some embodiments, the at least one cavity 300 is positioned on the first bent portion 505 and the at least one protrusion is positioned on the second bent portion 510, although the at least one cavity 300 may be positioned in other locations or orientations, and other cavities and protrusions may be included in other positions along the interlocking portions 120, 125.

The overall joining mechanism 115 can also resist relative movement between the interlocking portions 120, 125 along all three of the x-, y-, and z- axes due to the connection between the interlocking portions 120, 125 provided by the one or more fasteners 220. In some embodiments, the first fastener receptacle(s) 210 and the second fastener receptacle (s) 215 are positioned and configured to receive the fastener (s) 220 such that the fastener(s) 220 pass at least partially through the first interlocking portion 120 and into and at least partially through the second interlocking portion 125. In some embodiments, with specific reference to FIGS. 6 and 7, the fastener(s) 220 can be received in the second fastener receptacle(s) 215 to extend into the first fastener receptacle(s) 210, where the fastener(s) 220 join with corresponding nut(s) 600 or other suitable device(s).

In some embodiments, the fastener receptacle(s) 210, 215 may include boxes or other shapes positioned and configured to serve as surfaces and containers for the fastener(s) 220 and nut(s) 600 suitable for facilitating tightening of the connection between the fastener(s) 220 and nut(s) 600 in a manner that releasably connects the interlocking portions 120, 125 (and, therefore, the body portions 105, 110) together. In operation, a user can bring the body portions 105, 110 (including their respective interlocking portions 120, 125) together, to pass the fastener(s) 220 (which may be permanently or semi-permanently mounted in the second body portion 110 or the second interlocking portion 125) into the first interlocking portion 120, and then the nut(s) 600 may be tightened on the fastener(s) 220 to attach the body portions 105, 110 together for the surfboard 100 to be used.

In the reverse, a user can disassemble the nut(s) 600 from the fastener(s) 220 to separate the body portions 105, 110 from each other for storage, transportation, etc. The covering material 130 may cover the second fastener receptacles 215 and the second recesses 205 to permanently enclose a portion of the fastener(s) 220, while the covering material 130 may be omitted from covering the first fastener receptacle(s) 210 to provide access to the nut(s) 600 for tightening them.

With reference to at least each of FIGS. 5-8, the joining mechanism 115 can include one or more additional protrusions 605 and one or more corresponding additional cavities 800 positioned toward lateral ends of the interlocking portions 120, 125 (for example, away from the chevron shapes/bent portions) for receiving the one or more additional protrusions 605. The one or more additional protrusions 605 and additional cavities 800 may engage each other to further resist relative movement between the interlocking portions 120, 125, including relative rotation about the longitudinal axis (the x-axis).

In some embodiments, the surfboard 100 may be manufactured by forming the cores of the body portions 105, 110 (e.g., by cutting a whole surfboard or forming the portions separately) with edges and recesses (e.g., 200) for receiving the interlocking portions 125, 120. The body portions 105, 110 and the interlocking portions 120, 125 may be optionally coated with the covering material 130 to make the interlocking portions 120, 125 flush with the body portions 105, 110 (or the interlocking portions 120, 125 may be made or designed to already provide a flush surface). To assemble the surfboard 100, the fasteners 220 may be inserted through each interlocking portion 120, 125 and secured with corresponding nuts 600, which may be tightened to draw the body portions 105, 110 tightly together for use. Removal of the nuts facilitates separation of the body portions 105, 110 for storage, transportation, and so forth. The recesses (e.g., 200) provide access to the fastener(s) 220 and the nut(s) 600 from the exterior of the body portions 105, 110.

In some embodiments, the interlocking portions 120, 125 may be made with additive manufacturing, such as 3D-printing, or other suitable manufacturing methods including stamping, injection molding, and so forth. Although FIGS. 1-8 show the interlocking portions 120, 125 having generally rectangular shapes in the z-y plane, in some embodiments, the interlocking portions 120, 125 can be cut down or otherwise trimmed to match the contour of the body portions 105, 110 in the z-y plane (e.g., a rounded or oblong shape), which may help create the smooth uniform surface in the final surfboard assembly 100. In some embodiments, the interlocking portions 120, 125 can be made not in a rectangular shape in the z-y plane, but rather they may be initially constructed with a rounded shape that corresponds with the rounded shape of the body portions 105, 110 in cross-section (i.e., the z-y plane).

Figure 9:
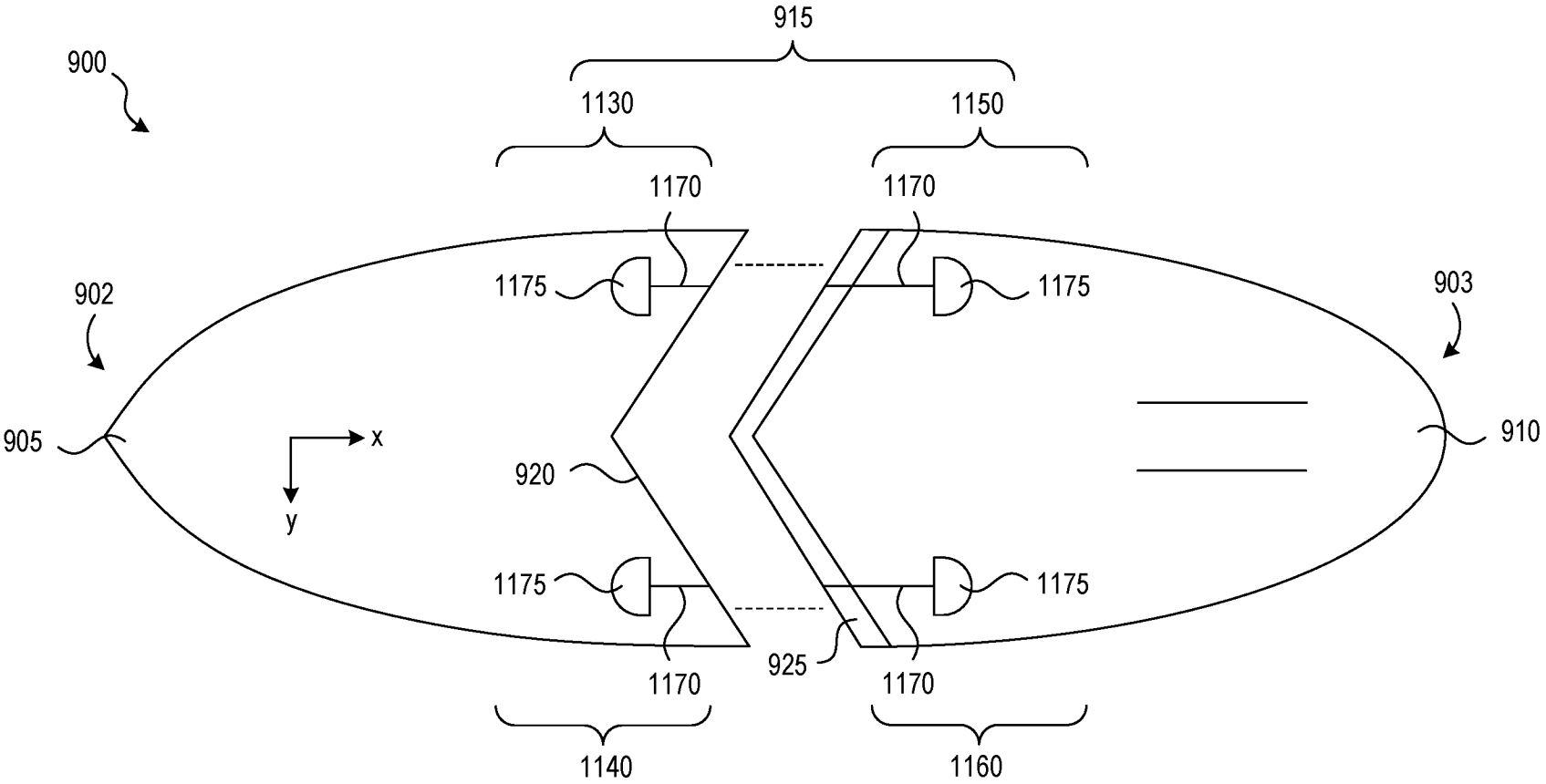
FIG. 9 illustrates a partially schematic top exploded or partially disassembled view of a waterboard or surfboard assembly configured in accordance with additional embodiments of the present technology.
Figure 10:
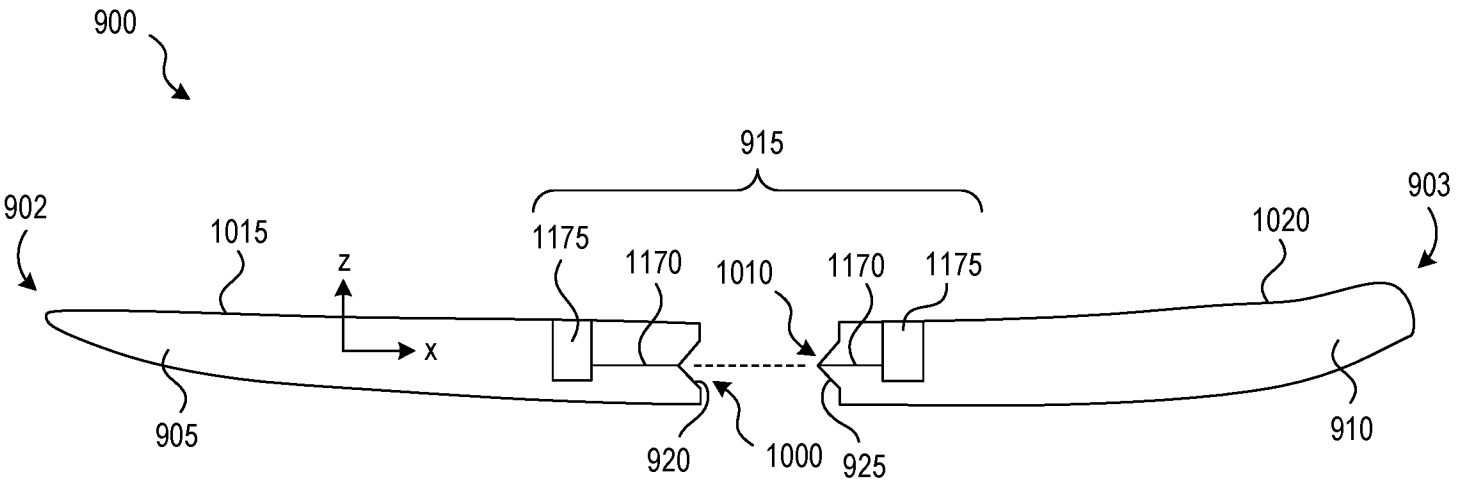
FIG. 10 is a partially schematic side view of the surfboard shown in FIG. 9, in a partially disassembled configuration.

FIG. 9 illustrates a partially schematic top exploded or partially disassembled view of a waterboard or surfboard assembly 900 (hereinafter referred to as a surfboard 900 for brevity) configured in accordance with additional embodiments of the present technology. FIG. 10 is a partially schematic side view of the surfboard 900 shown in FIG. 9, in a partially disassembled configuration.

Beginning with specific reference to FIG. 9, the surfboard 900 may be generally similar to the surfboard 100 described above with regard to FIGS. 1-8, but with some distinctions described in detail below with regard to FIGS. 9-18. For reference and example only, in some embodiments, the surfboard 900 may include a nose portion 902 and a tail portion 903 positioned opposite the nose portion 902. In some embodiments, the surfboard 900 includes a first body portion 905 and a second body portion 910 that are releasably attachable to one another, as described in additional detail below. However, in some embodiments, the surfboard 900 may include more than two body portions, such as three or more body portions. The surfboard 900 may include a joining mechanism 915 for releasably attaching the first body portion 905 to the second body portion 910. Accordingly, the joining mechanism 915 facilitates assembly and disassembly of the surfboard 900 to allow for compact storage and transportation between use.

With continuing reference to FIG. 9, in some embodiments, the first body portion 905 has a first edge 920 and the second body portion 910 has a second edge 925. The first edge 920 and the second edge 925 are shaped and configured to mate with each other. Accordingly, similar to the surfboard 100 described above with regard to FIGS. 1-8, the surfboard 900 has interlocking edges, although in the surfboard 900 shown in FIG. 9, the interlocking edges may be part of the surfboard body portions themselves, such that the interlocking edges form at least part of the interlocking portions of the body portions, and interlocking portions in the form of bracket elements (see FIG. 8) may be omitted. In FIG. 9, the edges 920, 925 may have or include intermeshing chevron shapes. The second edge 925 may enter into and interlock with the first edge 920. In some embodiments, the edges 920, 925 may be positioned on other body portions.

Although chevron shapes are described herein for various embodiments (e.g., those shown in FIGS. 1-17 and other figures), other embodiments may have other shapes. For example, interlocking shapes according to embodiments of the present technology may include arcuate shapes, sawtooth shapes, or other suitable shapes. In some embodiments, suitable shapes include any three-dimensional arrangement with interlocking three-dimensional shapes that resist relative motion between the body portions of the surfboard (e.g., surfboard 100 or surfboard 900, or others) in at least two dimensions (with the third dimension being constrained by fasteners or other connecting elements).

Turning to FIG. 10, in some embodiments, the first edge 920 may include or define a cavity 1000 that is positioned and configured to receive a leading-edge portion of a protrusion 1010 of the second edge 925. The interlocking shapes facilitate meshing/interlocking the body portions 905, 910. As is visible in FIG. 10, the protrusion 1010 may have a generally chevron shape and the cavity 1000 may have a generally corresponding chevron shape.

Figure 11:
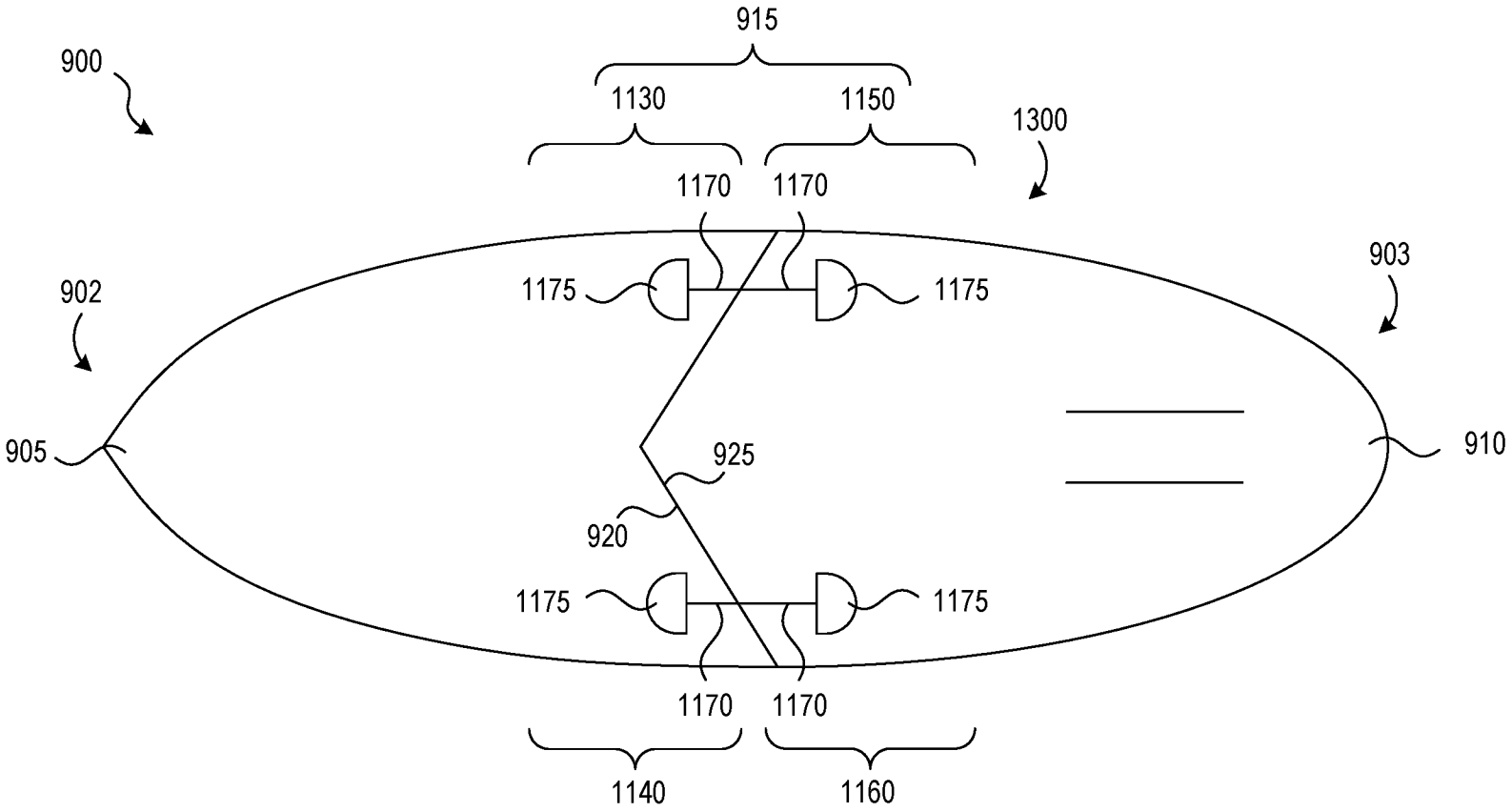
FIG. 11 is a partially schematic top view of the surfboard shown in FIGS. 9 and 10, in an assembled configuration.

With continuing reference to FIG. 10, and additional reference to FIG. 11 (which is a partially schematic top view of the surfboard 900 shown in FIGS. 9 and 10, in an assembled configuration), the first edge 920 and the second edge 925 are shaped and configured so that an upper surface 1015 of the first body portion 905 and an upper surface 1020 of the second body portion 910 are substantially flush with each other when the surfboard 900 is assembled, such that there is little or no gap between the edges 920, 925 and the body portions 905, 910 (similar to how there would be little or no gap between the interlocking portions 120, 125 when the surfboard 100 described above is assembled, and how the surfaces of the surfboard 100 would be substantially flush when the covering material 130 is applied). Similarly, the bottom surfaces of the surfboard 900 may also be substantially flush with one another to form a generally smooth surface like a surface that may be found in a conventional surfboard.

With continuing reference to FIGS. 9-11, the meshing/interlocking arrangement of the edges 920, 925 (and of the interlocking portions 120, 125 described above with regard to FIGS. 1-8) may improve stability of the surfboard 900 (and 100 described above) when assembled and in use. In addition, the meshing/interlocking arrangement may reduce stress on the joining mechanisms 115, 915 vertically, horizontally, or both (i.e., in at least two directions/dimensions). For example, the shapes of the edges 920, 925 (and of the interlocking portions 120, 125) may resist or prevent the body portions 905, 910 from sliding relative to one another in the lateral and thickness directions (and likewise for the interlocking portions 120, 125). Connection is established, and stress may be managed, along the longitudinal axis (x-axis) with fasteners or other suitable longitudinal connections between the body portions. For example, reducing the forces incident on the joining mechanisms 115, 915 (via the fasteners or other components) may also reduce the reaction force(s) on the body portions, which may further reduce risk of damage to the overall surfboards.

Figure 12:
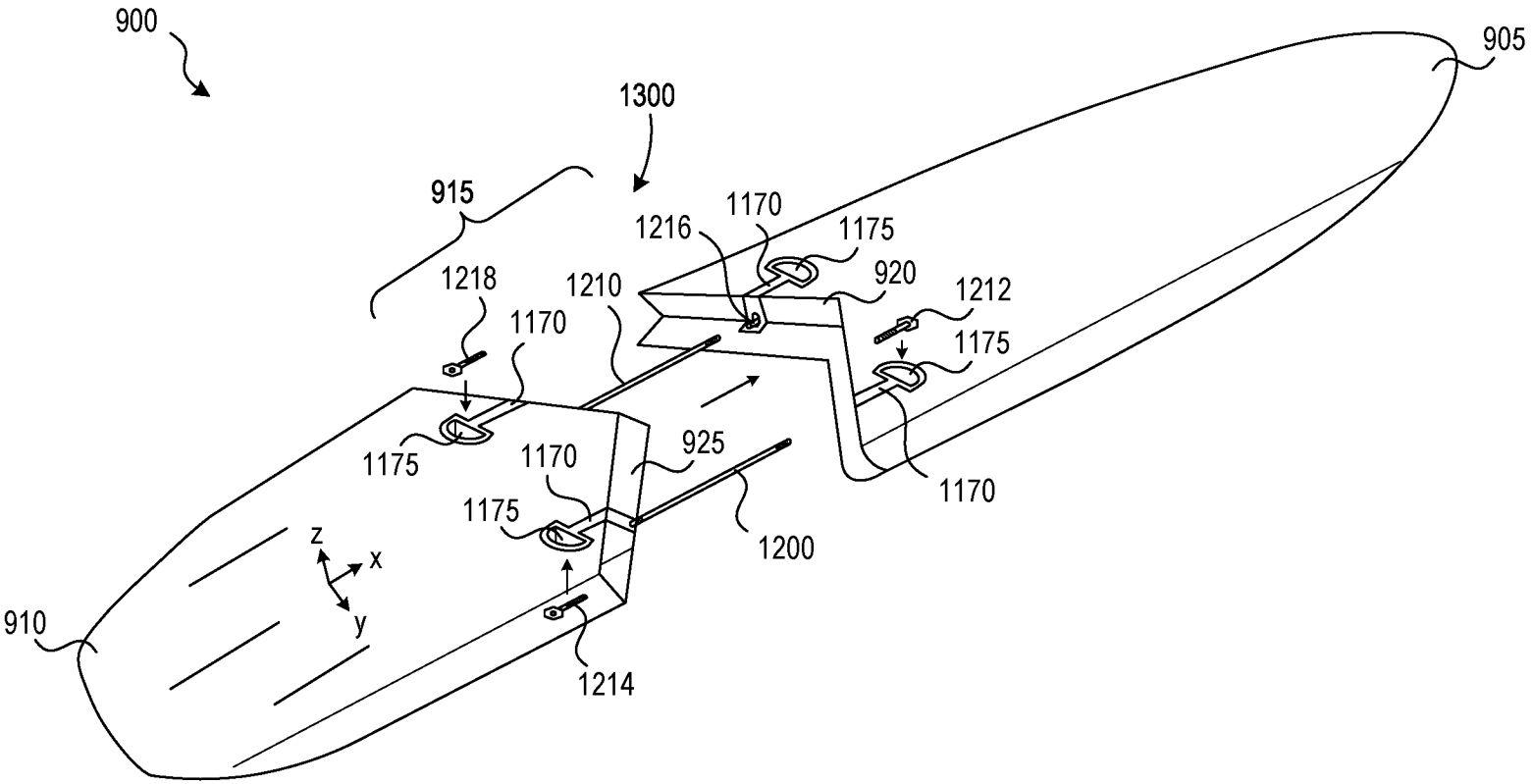
FIG. 12 is a partially schematic perspective view of the surfboard shown in FIG. 9, in a partially disassembled configuration, or during an assembly or disassembly process.
Figure 13A:
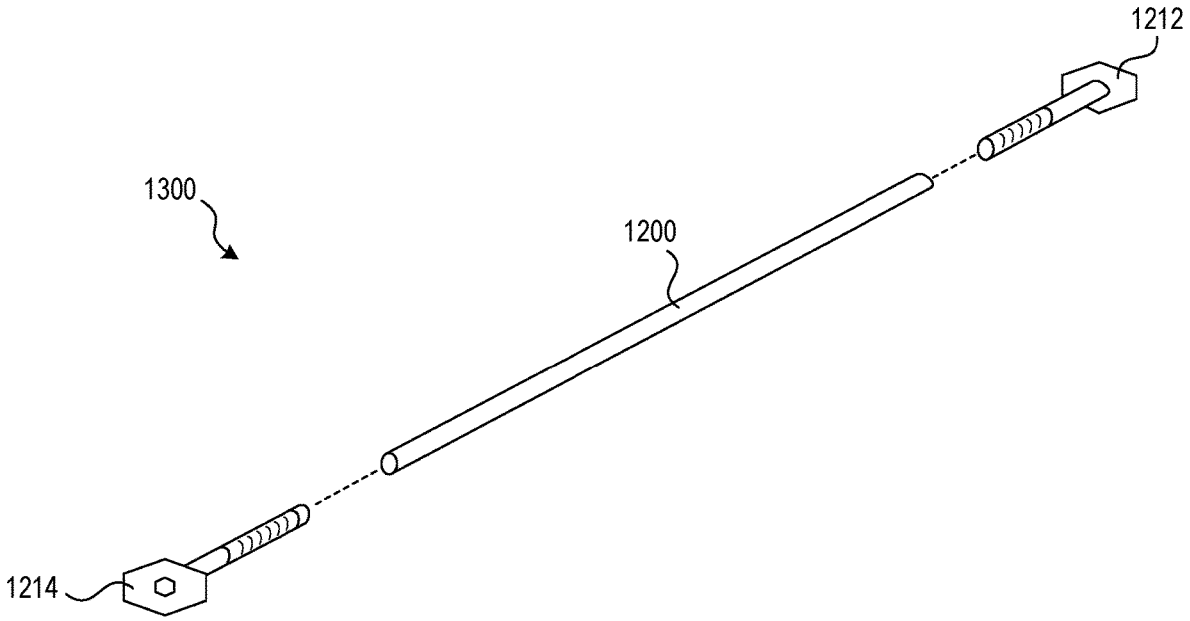
FIG. 13A is a partially schematic perspective view of at least a portion of a fastener system suitable for the surfboard shown in FIG. 9 or other waterboards, in accordance with embodiments of the present technology, in a disconnected or disassembled (unfastened) configuration.
Figure 13B:
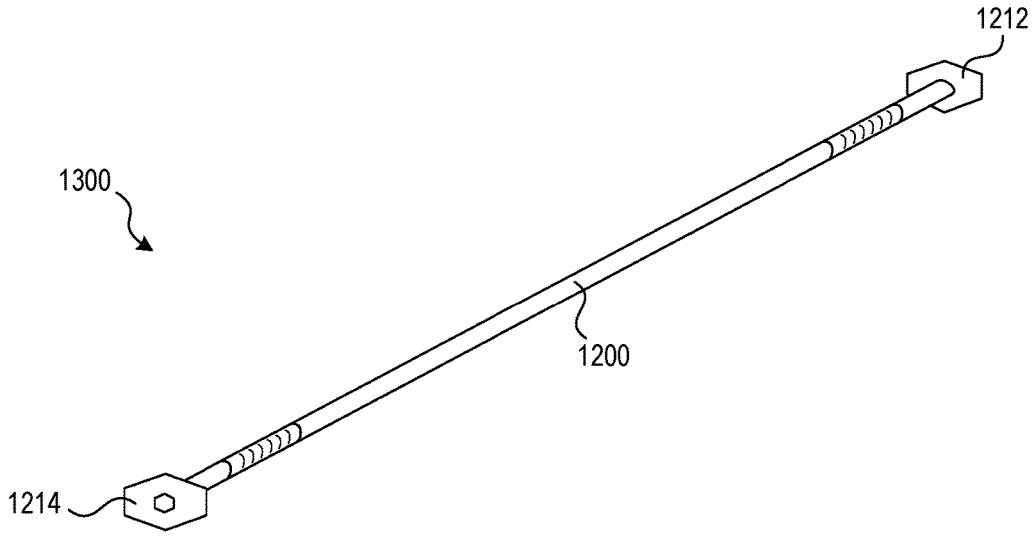
FIG. 13B is a perspective view of the portion of the fastener system shown in FIG. 13A, in a connected or assembled configuration.

FIG. 12 is a partially schematic perspective view of the surfboard 900 shown in FIG. 9, in a partially disassembled configuration, or during an assembly or disassembly process. FIG. 13A is a partially schematic perspective view of at least a portion of a fastener system 1300 suitable for the surfboard 900 shown in FIG. 9, in accordance with embodiments of the present technology, in a disconnected or disassembled (unfastened) configuration. FIG. 13B is a perspective view of the portion of the fastener system 1300 shown in FIG. 13A, in a connected or assembled configuration. With reference to FIGS. 12, 13A, and 13B, in some embodiments, the joining mechanism 915 (and the fastener system 1300) includes a first fastener 1200 (such as a stud), a second fastener 1210 (such as a stud), a first nut 1212, a second nut 1214, a third nut 1216, and a fourth nut 1218. The first fastener 1200 may be assembled with the first nut 1212 on one end and the second nut 1214 on the other end. Similarly, the second fastener 1210 may be assembled with the third nut 1216 and the fourth nut 1218 on opposing ends from each other. Although the nuts 1212, 1214, 1216, 1218 are illustrated as having threaded studs (which may engage threaded bores in the fasteners or studs), in some embodiments, the nuts 1212 may be standard nuts without threaded studs, and they may engage threaded outer surfaces of the fasteners or studs. In general, embodiments of the present technology may include any suitable nuts, fasteners, studs, or other fastening devices.

The fasteners 1200, 1210 and the nuts 1212, 1214, 1216, 1218 may be embedded or otherwise positioned within the thickness of the body portions 905, 910. Advantageously, this ensures that the fastener system 1300 does not unduly interfere with use of the assembled surfboard 900 (e.g., an exposed fastener system 1300 or other components could cause injury). Another advantage is that the fastener system 1300 (and the fasteners described above with regard to FIGS. 1-8) may be positioned toward a middle region of the thickness (along the z-axis) of the surfboard 900, which may improve structural integrity of the assembly.

With additional reference to FIG. 11, in some embodiments, each body portion 905, 910 may include recesses or receptacles for a user to access the fastener system 1300. For example, the first body portion 905 may have a first recess 1130 and a third recess 1140 to enable a user to access the nuts 1212, 1216 for tightening and loosening on the corresponding studs. The second body portion 910 may have a second recess 1150 and a fourth recess 1160 to provide access to the nuts 1214, 1218 for tightening and loosening on the corresponding studs. In some embodiments, the first recess 1130 may be substantially aligned with the second recess 1150, and the third recess 1140 may be substantially aligned with the fourth recess 1160. Such alignment enables the fasteners 1200, 1210 to be received between corresponding recesses containing the corresponding nuts.

In some embodiments, each recess 1130, 1140, 1150, 1160 includes a fastener receiver 1170. In some embodiments, each recess 1130, 1140, 1150, 1160 includes a slot 1175 for receiving corresponding nuts 1212, 1214, 1216, 1218. The fastener receivers 1170 align with opposing fastener receivers 1170 on each body portion to receive the fasteners 1200, 1210 and allow the fasteners 1200, 1210 to pass into each of the body portions 905, 910. The nuts 1212, 1214, 1216, 1218 fasten on the fasteners and against parts of the body portions 905, 910 to hold the body portions 905, 910 together. Other suitable numbers or arrangements of fasteners, including multiples of those describe herein, may be implemented in various embodiments of the present technology.

Figure 14A:
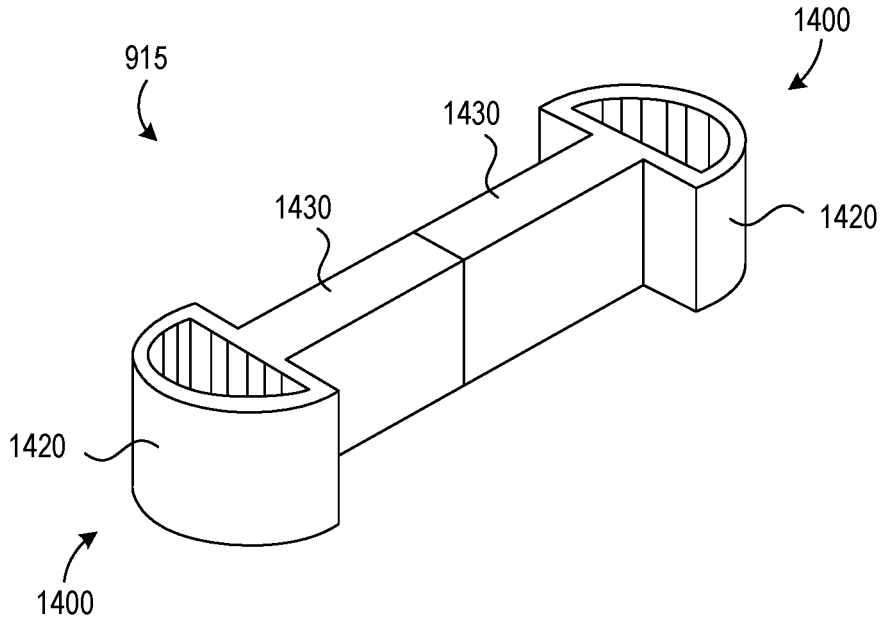
FIG. 14A is a partially schematic perspective view of at least a portion of a joining mechanism configured in accordance with an embodiment of the present technology, in an assembled or fastened configuration.
Figure 14B:
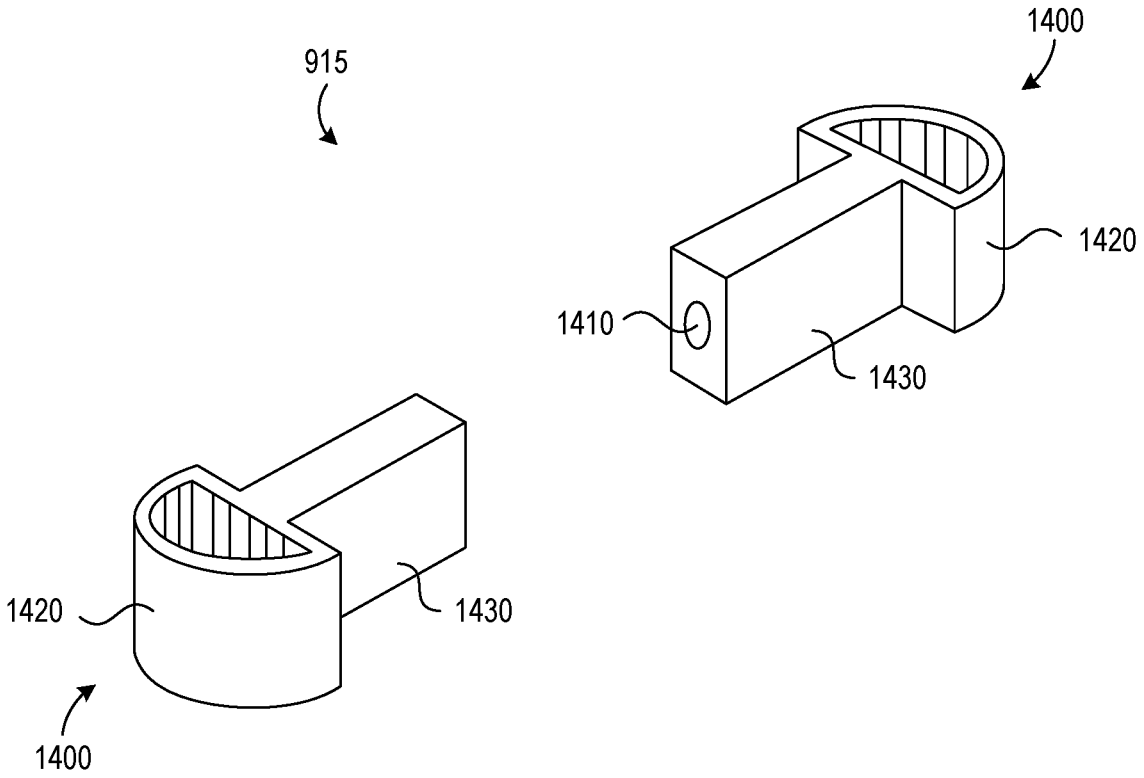
FIG. 14B is a partially schematic perspective view of at least a portion of the joining mechanism in a disassembled or unfastened configuration.

FIG. 14A is a partially schematic perspective view of at least a portion of a joining mechanism 915 configured in accordance with an embodiment of the present technology, in an assembled or fastened configuration. FIG. 14B is a partially schematic perspective view of at least a portion of the joining mechanism 915 in a disassembled or unfastened configuration. In some embodiments, the joining mechanism 915 may include one or more (such as four) reinforcing components 1400. In some embodiments, each of the one or more reinforcing components 1400 may be embedded in, mounted in, or otherwise carried in the surfboard 900 to further support the fastener system 1300 and to protect the body portions 905, 910 from stresses due to engagement with the fastener system 1300.

With brief reference to FIG. 12, the reinforcing components 1400 may be positioned in the fastener receivers 1170 and the slots 1175 to form reinforced fastener receivers 1170 and slots 1175 by lining the fastener receivers 1170 and slots 1175. In some embodiments, each body portion 905, 910 may receive two reinforcing components 1400 (corresponding to two fasteners 1200, 1210 and four nuts 1212, 1214, 1216, 1218). The reinforcing components 1400 may assist with spreading forces of the connection between the body portions 905, 910, thereby reducing damage from use.

Returning to FIGS. 14A and 14B, in some embodiments, one or more of the reinforcing components 1400 may include an aperture 1410 through which the fasteners 1200, 1210 may pass. In some embodiments, one or more of the reinforcing components 1400 may have a mushroom shape, with a head region 1420 and a stem region 1430 extending from the head region 1420. The head regions 1420 may line the slots 1175 and the stem regions 1430 may line the fastener receivers 1170. In some embodiments, the head regions 1420 are broader/wider than their corresponding stem regions 1430 and fastener receivers 1170. The head regions 1420 may receive corresponding nuts 1212, 1214, 1216, 1218, and the broader/wider configuration of the head regions 1420 may help distribute forces from the nuts, reducing risk of damage or failure of the surfboard 900 or components thereof (e.g., reducing the risk of the nuts or the head regions from pulling through or out of the respective body portions 905, 910).

The reinforcing components 1400 may be formed from any suitable material, such as a metal or plastic material (e.g., injection molding). The reinforcing components 1400 are optional and may be omitted in some embodiments.

Figure 15:
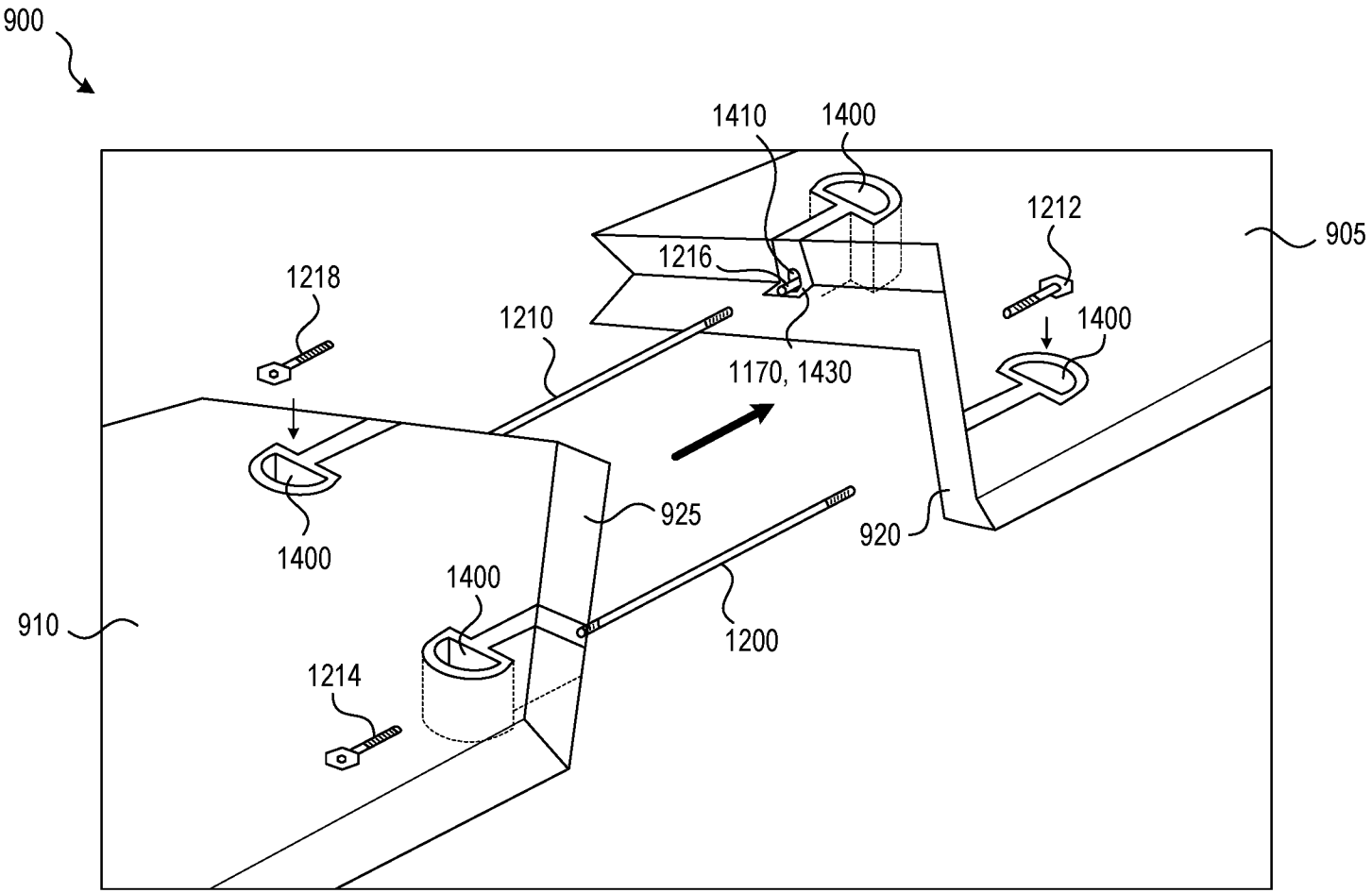
FIG. 15 is a partially schematic detailed perspective view of the joining mechanism in the surfboard of FIG. 9, in a partially disassembled configuration, or during an assembly or disassembly process.

FIG. 15 is a partially schematic detailed perspective view of the joining mechanism 915 in the surfboard 900 in a partially disassembled configuration, or during an assembly or disassembly process, in accordance with embodiments of the present technology. Specifically, FIG. 15 shows the optional reinforcing components 1400 positioned in the body portions 905, 910.

Figure 16:
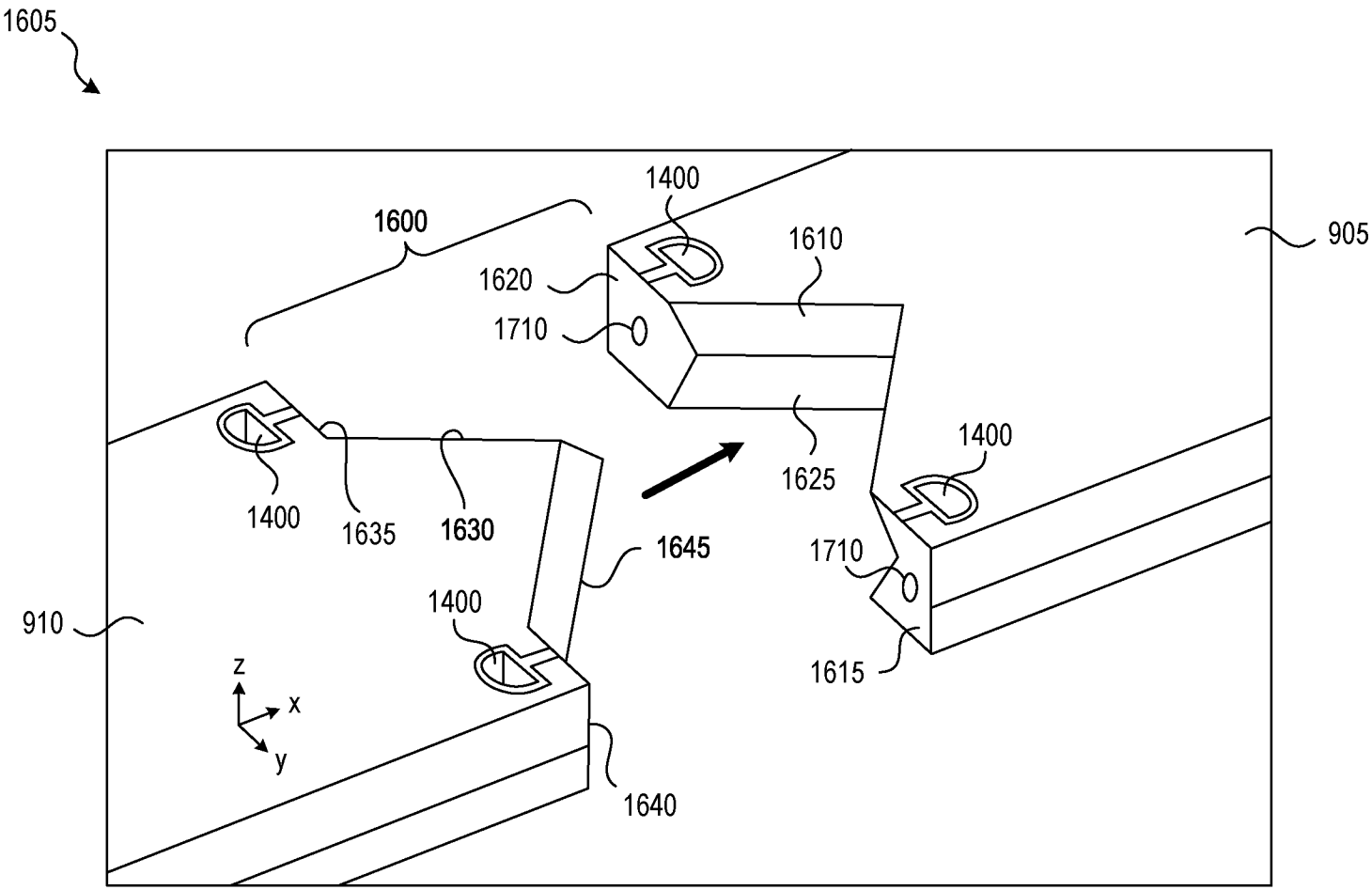
FIG. 16 illustrates a partially schematic detailed perspective view of a joining mechanism in a surfboard configured in accordance with additional embodiments of the present technology, in a partially disassembled configuration or during an assembly or disassembly process.

FIG. 16 illustrates a partially schematic detailed perspective view of a joining mechanism 1600 in a surfboard 1605 configured in accordance with embodiments of the present technology, in a partially disassembled configuration or during an assembly or disassembly process. The joining mechanism 1600 and the surfboard 1605 may be generally similar to other joining mechanisms and surfboards disclosed herein, except that FIG. 16 shows an alternate shape and configuration for the interfacing surfaces or edges of the body portions 905, 910.

In some embodiments, a first edge 1610 includes lateral regions 1615, 1620 and a central region 1625 configured to receive a portion of a second edge 1630. In some embodiments, the second edge 1630 includes lateral regions 1635, 1640 and a central region 1645 which is also a protruding region. The lateral regions 1635, 1640 may be substantially aligned along a plane including the vertical axis (z-axis) and along a lateral (y-axis) plane, while the central region 1645 may have a projecting pointed (chevron) or otherwise projecting shape relative to the vertical and lateral planes (other embodiments, including those described above, may include the projecting pointed chevron or other shape relative to vertical and lateral planes, with or without lateral regions). Correspondingly, the central region 1625 of the first edge 1610 may include a chevron-like shape in the vertical and lateral directions for receiving the central region 1645 of the second edge 1630. The lateral regions are shaped and positioned to bear against each other. The optional reinforcing components 1400 are also shown in FIG. 16.

Figure 17:
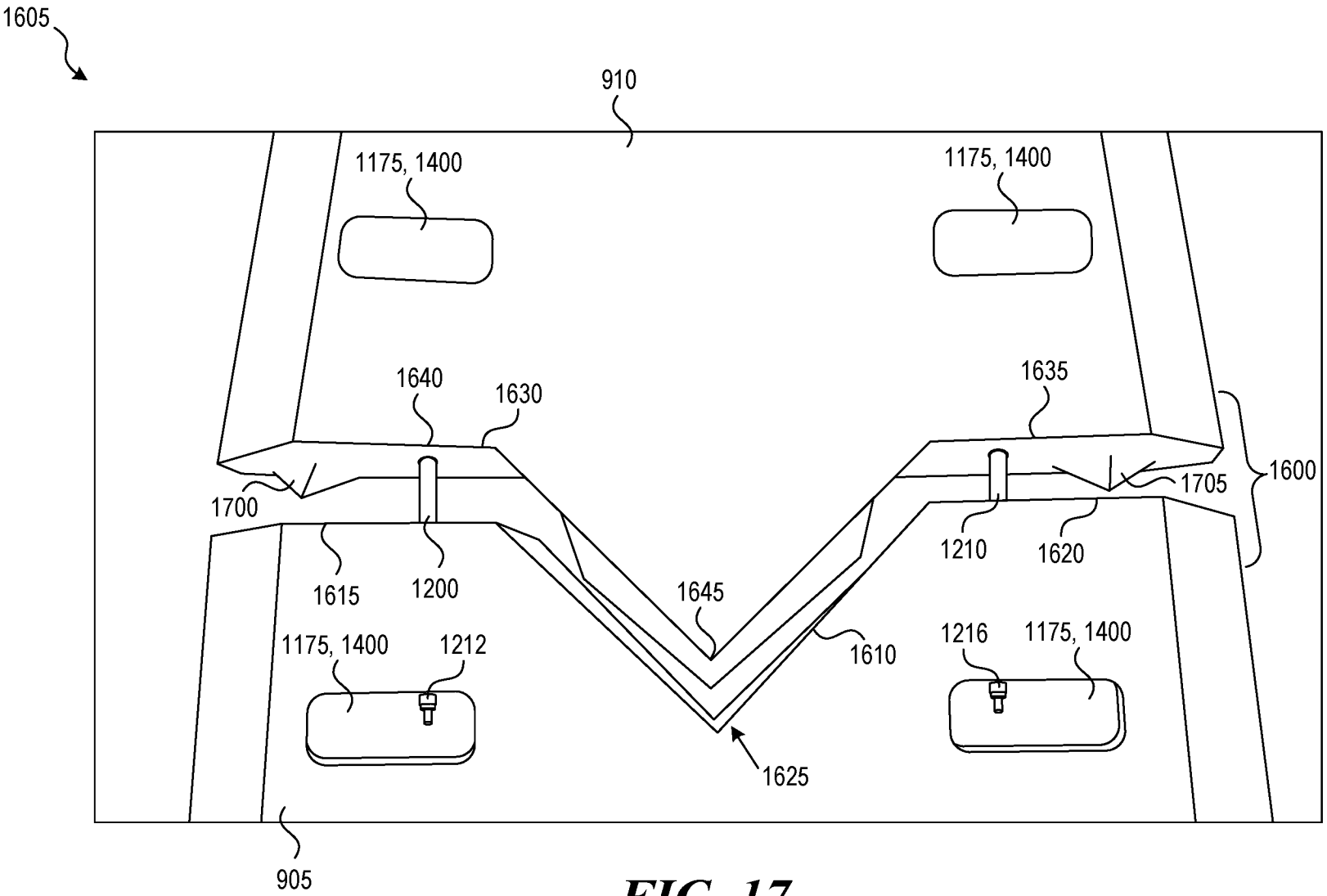
FIG. 17 illustrates a partially schematic detailed perspective view of the joining mechanism in FIG. 16, but with differently shaped elements.

FIG. 17 illustrates a partially schematic detailed perspective view of the joining mechanism 1600, albeit with differently shaped elements. In some embodiments, the joining mechanism 1600 may include one or more additional protrusions 1700, 1705 on the lateral regions (such as the lateral regions 1635, 1640) and one or more additional cavities 1710 on opposing lateral regions (such as the lateral regions 1615, 1620) for receiving the additional protrusions 1700, 1705.

Accordingly, the surfboard 1605 may include a plurality of interlocking regions, such as first and second interlocking regions formed by the additional protrusions 1700, 1705 and the corresponding additional cavities 1710 and a third interlocking region formed by the chevron shapes in the central regions 1625, 1645. Optionally, these interlocking regions (which may also be called interlocking portions herein) may be formed by bracket elements attached to the mating ends of the body portions 905, 910. The interlocking regions reduce or prevent relative motion between the body portions 905, 910.

In any of the embodiments of the surfboards, waterboards, or other recreational devices disclosed herein, body portions may have mating male and female portions (such as the first edges forming female portions and the second edges forming male portions, or vice versa). The edges may have other complementary shapes for engaging each other, and may be oppositely configured to those disclosed herein. In general, the edges mesh together to facilitate flush assembly and to reduce or prevent relative motion between the body portions in lateral (y-axis) and thickness (z-axis) directions, and in rotational directions, while fasteners hold the body portions together along the longitudinal axis (x-axis).

Figure 18:
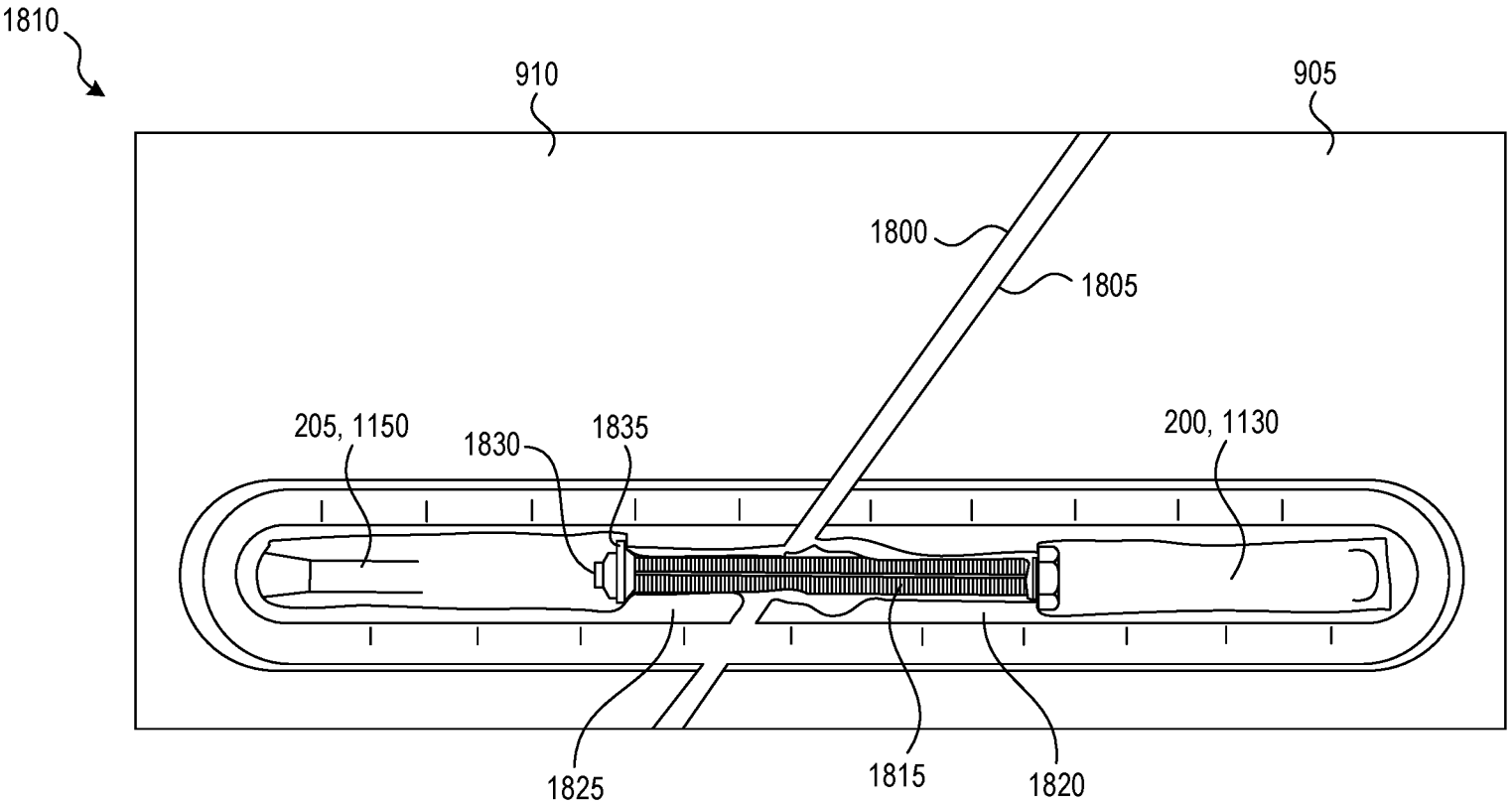
FIG. 18 is a partially schematic detailed view of joining edges and a joining mechanism for a surfboard or waterboard in an at least partially assembled configuration, in accordance with additional embodiments of the present technology.

FIG. 18 is a partially schematic detailed view of joining edges 1800, 1805 and a joining mechanism 1810 for a surfboard (such as one or more of the surfboards disclosed herein), in a generally assembled configuration, in accordance with embodiments of the present technology. Although a gap is visible between the edges 1800, 1805, such a gap may be minimal or nonexistent and is only for illustration of the joining mechanism 1810. The joining mechanism 1810 may include a bolt 1815 (or other suitable threaded rod) which is positionable to pass through fastener receivers 1820, 1825 mounted in the body portions, respectively. The bolt 1815 may be secured using a nut 1830 and an optional washer 1835.

Figure 19:
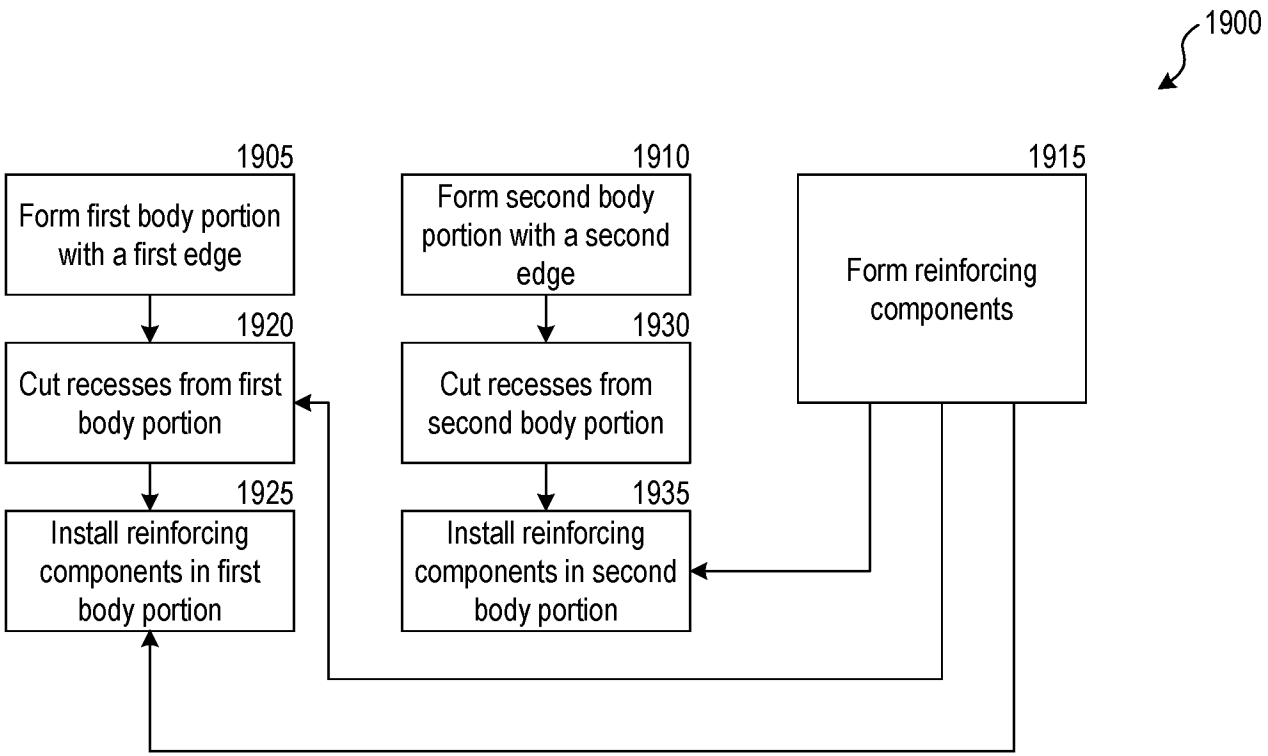
FIG. 19 is a flow-chart showing steps of a method of manufacturing a surfboard in accordance with an embodiment of the present technology.

FIG. 19 is a flow-chart showing steps of a method 1900 of manufacturing a surfboard in accordance with an embodiment of the present technology, such as the surfboards 900, 1605 described above, or other surfboards. In some embodiments, at block 1905, the first body portion (e.g., 105, 905) may be formed with a first edge (e.g., 920). At block 1910, the second body portion (e.g., 110, 910) may be formed with a second edge (e.g., 925). In some embodiments, the shape and dimensions of the first and second edges may be configured to mesh with each other to form the board when the body portions are assembled.

At block 1915, the reinforcing components (e.g., 1400) may be formed. The shape and size of the reinforcing components may be according to the shape and size of the recesses that will receive the reinforcing components (or the recesses can be shaped and sized based on the reinforcing components). At block 1920, the recesses (e.g., 200, 1130, 1140) may be cut out from the first body portion. The recesses may be configured to receive or allow access to tighten or loosen fasteners of the joining mechanism, which may be accessible to the exterior of the body portions via the recesses.

At block 1925, reinforcing components (e.g., 1400) may be positioned in the recesses in the first body portion. At block 1930, the recesses (e.g., 200, 1150, 1160) may be cut out from the second body portion. The recesses may be configured to receive or allow access to tighten or loosen fasteners of the joining mechanism. At block 1935, reinforcing components (e.g., 1400) may be positioned in the recesses of the second body portion.

With reference to at least FIGS. 9-18, after manufacturing, the surfboard may be assembled or disassembled by inserting fasteners (e.g., 1200, 1210) into the reinforcing components (e.g., through apertures 1410), and attaching nuts (e.g., 1212, 1214, 1216, 1218, and so forth) to the fasteners and tightening the nuts to draw the body portions together for the surfboard to be used. To disassemble the surfboard for storage, transportation, and so forth, nuts may be removed and the body portions may be separated. The recesses (e.g., 200, 1130, 1140, 1150, 1160) provide access points for tightening and loosening the nuts (and again, optionally, reinforcing components 1400 may line one or more of the recesses).

Some embodiments of the present technology may include a kit of parts for a recreational device, waterboard, or surfboard disclosed herein. In some embodiments, any of the parts or components disclosed herein may be included in a such a kit, in any quantity, permutation, or combination of elements. For example, and in general, the technology comprises portions of a surfboard and joining mechanisms attachable together.

Advantages of the present technology include a waterboard or surfboard or other recreational device that can be separated into components for storage or transportation and easily assembled for use, providing a user the ability, for example, to travel with a surfboard that may otherwise be difficult or even impossible to travel with.

From the foregoing, it will be appreciated that specific embodiments of the presently disclosed technology have been described herein for purposes of illustration, but that various modifications may be made without deviating from the scope of the technology. For example, although a top and bottom and a nose and tail are described, those designations may be switched, and other portions may have other arrangements or orientations. Although designations such as first, second, third, fourth, and so forth may be used herein, such designations are not limiting and are for example purposes only. Although surfboards are described in detail, other embodiments of the present technology include other waterboards or recreational structures (such as boogie boards, snowboards, surfboards, or other rideable recreational structures) that may include some or all of the connecting or joining features described herein. Although two fasteners or fastening devices may be illustrated and described herein, other embodiments may include any other suitable quantity of fasteners or fastening devices. For example, in some embodiments, fastener mechanisms for joining the board portions together may include cam devices that connect to the fasteners or studs.

Certain aspects of the technology described in the context of particular embodiments may be combined or eliminated in other embodiments. Further, while advantages associated with certain embodiments of the presently disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

To the extent any materials incorporated herein by reference conflict with the present disclosure, the present disclosure controls.

What is claimed is:

1. A waterboard assembly comprising:

a first body portion;

a second body portion; and a joining mechanism positioned to releasably attach the first body portion to the second body portion; wherein:

the joining mechanism comprises a first interlocking portion and a second interlocking portion;

the first interlocking portion is attached to, integral with, or part of, the first body portion;

the second interlocking portion is attached to, integral with, or part of, the second body portion;

the first interlocking portion releasably interlocks with the second interlocking portion;

the first body portion comprises one or more first recesses containing at least part of the first interlocking portion;

the second body portion comprises one or more second recesses containing at least part of the second interlocking portion;

the one or more first recesses contain one or more first fastener receptacles, and the one or more second recesses contain one or more second fastener receptacles;

the first interlocking portion comprises a bracket element that extends along a lateral axis of the waterboard assembly, a first bent portion extending along a longitudinal axis of the waterboard assembly, and at least one cavity;

the second interlocking portion comprises a bracket element that extends along the lateral axis, a second bent portion extending along the longitudinal axis and positioned to engage the first bent portion, and at least one protrusion positioned or positionable to engage the at least one cavity;

the at least one cavity is positioned on the first bent portion; and the at least one protrusion is positioned on the second bent portion.

2. The waterboard assembly of claim 1, wherein the first interlocking portion and the second interlocking portion comprise interlocking angular shapes that, when interlocked, resist relative movement between each other in at least two dimensions.

3. The waterboard assembly of claim 1, further comprising one or more fasteners positioned or positionable to attach the first interlocking portion to the second interlocking portion.

4. The waterboard assembly of claim 1, wherein:

the one or more first fastener receptacles and the one or more second fastener receptacles are positioned to receive one or more corresponding fasteners for connecting the first interlocking portion to the second interlocking portion by passing through the first interlocking portion and the second interlocking portion.

5. The waterboard assembly of claim 1, further comprising one or more layers of covering material, wherein the covering material comprises at least one of an epoxy material, a fiberglass material, a composite material, or a plastic material, and wherein the covering material is shaped and configured to form a generally uniform surface along the waterboard assembly when the first body portion is attached to the second body portion.

6. The waterboard assembly of claim 1, wherein the first body portion comprises a nose of the waterboard assembly, and wherein the second body portion comprises a tail of the waterboard assembly.

7. The waterboard assembly of claim 1, wherein each of the first body portion and the second body portion comprises a foam material.

8. The waterboard assembly of claim 1, further comprising one or more third body portions.

9. A waterboard assembly, comprising:

a plurality of body portions comprising at least a first body portion and a second body portion connectable to the first body portion along a longitudinal axis of the waterboard assembly, wherein the first body portion comprises a first edge, and the second body portion comprises a second edge configured to engage the first edge;

one or more first recesses in the first body portion;

one or more first reinforcing components positioned in the one or more first recesses and configured to reinforce the one or more first recesses;

one or more second recesses in the second body portion;

one or more second reinforcing components positioned in the one or more second recesses and configured to reinforce the one or more second recesses; and one or more fasteners positionable to extend between the first body portion and the second body portion, and into the one or more first recesses and the one or more second recesses for connecting the first and second body portions, wherein the one or more fasteners are accessible to an exterior of the waterboard assembly via the one or more first recesses or the one or more second recesses;

wherein:

the first edge comprises a projection having a first chevron shape;

the second edge comprises a cavity having a second chevron shape configured to receive the projection; and when the first body portion is connected to the second body portion, they form a flush surface.

10. The waterboard assembly of claim 9 wherein the first edge and the second edge comprise interlocking shapes that resist relative motion between the first body portion and the second body portion along at least two dimensions.

11. The waterboard assembly of claim 9, further comprising one or more additional projections and recesses positioned on the first edge or the second edge.

* * * * *